US011043070B2

(12) United States Patent
Anderson et al.

(10) Patent No.: US 11,043,070 B2
(45) Date of Patent: Jun. 22, 2021

(54) METHODS OF TRANSFERRING FUNDS IN A CASHLESS WAGERING SYSTEM

(71) Applicant: WMS Gaming, Inc., Waukegan, IL (US)

(72) Inventors: Peter R. Anderson, Glenview, IL (US); Mark B. Gagner, West Chicago, IL (US); Anuradha Jandhyala, Chicago, IL (US); Sean P. Kelly, Chicago, IL (US); Vladislav Modilevsky, Chicago, IL (US); Justin A. Perkins, Chicago, IL (US); Nickey C. Shin, Chicago, IL (US); Craig J. Sylla, Round Lake, IL (US); Matthew J. Ward, Northbrook, IL (US); Jorge L. Shimabukuro, Las Vegas, NV (US)

(73) Assignee: SG GAMING, INC., Las Vegas, NV (US)

( * ) Notice: Subject to any disclaimer, the term of this patent is extended or adjusted under 35 U.S.C. 154(b) by 568 days.

(21) Appl. No.: 14/499,048

(22) Filed: Sep. 26, 2014

(65) Prior Publication Data

US 2015/0065231 A1 Mar. 5, 2015

Related U.S. Application Data

(63) Continuation-in-part of application No. 14/260,025, filed on Apr. 23, 2014, now abandoned.

(60) Provisional application No. 61/815,601, filed on Apr. 24, 2013.

(51) Int. Cl.
*G07F 17/32* (2006.01)

(52) U.S. Cl.
CPC ..... *G07F 17/3248* (2013.01); *G07F 17/3225* (2013.01)

(58) Field of Classification Search
CPC .... A63F 9/24; G07F 17/3225; G07F 17/3241; G07F 17/3244; G07F 17/3251; G07F 17/42
See application file for complete search history.

(56) References Cited

U.S. PATENT DOCUMENTS 5,709,603 A 1/1998 Kaye
6,652,380 B1 11/2003 Luciano
7,641,555 B2 1/2010 McKinley et al.
(Continued)

OTHER PUBLICATIONS

"System Based, System Supported, and Mobile Gaming Technology Overview" published by Adam Fong, accessed and printed from URL <http://gaming.nv.gov/Modules/ShowDocument.aspx?documentid=3702>, 19 pages.*
(Continued)

*Primary Examiner* — Omkar A Deodhar
(74) *Attorney, Agent, or Firm* — DeLizio Law, PLLC

(57) ABSTRACT

A method for processing wagering game e-tickets is described herein. The method can include receiving, from a mobile device over a network, an indication to create an e-ticket. The method can also include determining, by a wagering game server, monetary value information for the e-ticket. The method can also include transmitting, to a ticketing server, the monetary value information; receiving, from the ticketing server, e-ticket information. The method can also include transmitting, over the network, the e-ticket information to the mobile device for generating the e-ticket.

22 Claims, 18 Drawing Sheets

(56) References Cited

U.S. PATENT DOCUMENTS

| | | | | |
|---|---|---|---|---|
| 8,272,947 | B2 | 9/2012 | Gagner et al. | |
| 8,282,465 | B2 | 10/2012 | Giobbi | |
| 8,333,655 | B2 | 12/2012 | Gagner et al. | |
| 8,342,944 | B2 | 1/2013 | Gagner | |
| 8,556,707 | B2 | 10/2013 | Potts et al. | |
| 8,734,236 | B2 | 5/2014 | Arezina et al. | |
| 2007/0129136 | A1 | 6/2007 | Walker et al. | |
| 2008/0076528 | A1 | 3/2008 | Nguyen et al. | |
| 2009/0131146 | A1 | 5/2009 | Arezina et al. | |
| 2009/0170594 | A1 | 7/2009 | Delaney et al. | |
| 2010/0016067 | A1 | 1/2010 | White et al. | |
| 2010/0093421 | A1 | 4/2010 | Nyman et al. | |
| 2010/0227670 | A1 | 9/2010 | Arezina et al. | |
| 2010/0285869 | A1 | 11/2010 | Walker et al. | |
| 2011/0065496 | A1 | 3/2011 | Gagner et al. | |
| 2011/0086693 | A1 | 4/2011 | Guziel et al. | |
| 2011/0165933 | A1 | 7/2011 | Guziel et al. | |
| 2011/0183745 | A1 | 7/2011 | Gagner et al. | |
| 2011/0207531 | A1* | 8/2011 | Gagner ..... | G07F 17/3248 463/30 |
| 2012/0202571 | A1 | 8/2012 | Stanek et al. | |
| 2012/0302324 | A1 | 11/2012 | Guinn et al. | |
| 2013/0017884 | A1 | 1/2013 | Price et al. | |
| 2013/0023339 | A1 | 1/2013 | Davis et al. | |
| 2013/0053129 | A1 | 2/2013 | Lemay et al. | |
| 2013/0053136 | A1 | 2/2013 | Lemay et al. | |
| 2013/0053148 | A1 | 2/2013 | Nelson et al. | |
| 2013/0065666 | A1 | 3/2013 | Schueller et al. | |
| 2013/0065667 | A1 | 3/2013 | Nelson et al. | |
| 2013/0065668 | A1 | 3/2013 | Lemay et al. | |
| 2013/0065678 | A1 | 3/2013 | Nelson et al. | |
| 2013/0065686 | A1 | 3/2013 | Lemay et al. | |
| 2013/0084963 | A1 | 4/2013 | Shorrock et al. | |
| 2014/0080564 | A1 | 3/2014 | Acres et al. | |
| 2014/0087880 | A1 | 3/2014 | Betts et al. | |
| 2014/0162768 | A1 | 6/2014 | Nelson et al. | |
| 2014/0206436 | A1 | 7/2014 | French | |
| 2014/0274306 | A1 | 9/2014 | Crawford, III et al. | |
| 2014/0323206 | A1 | 10/2014 | Gagner et al. | |
| 2015/0050977 | A1 | 2/2015 | Omar | |
| 2015/0072762 | A1 | 3/2015 | Curtin et al. | |
| 2015/0087408 | A1 | 3/2015 | Siemasko et al. | |
| 2015/0170473 | A1 | 6/2015 | Hematji et al. | |
| 2015/0228153 | A1 | 8/2015 | Hedrick et al. | |
| 2016/0071373 | A1 | 3/2016 | Anderson | |

OTHER PUBLICATIONS

Countr GMBH, "Tickets at Table Games", TITA, 2012, 2 pages.

Konami Gaming, Inc., "Marketing: Connect your Business with your Patrons Effortlessly", Konami SYNKROS App Webpage, 2014, 4 pages.

Pappano, "The Rise of Cashless Gaming", Indian Gaming, Apr. 2014, pp. 36-37.

Co-pending U.S. Appl. No. 14/260,025, filed Apr. 23, 2014, 53 pages.

"Australian Patent Application No. 2014202215, Examination Report", dated Apr. 10, 2015, 4 pages.

"U.S. Appl. No. 14/260,025 Office Action", dated Jul. 7, 2015, 8 Pages.

"U.S. Appl. No. 14/260,025 Final Office Action", dated Apr. 21, 2016, 10 pages.

Co-Pending U.S. Appl. No. 14/852,231, filed Sep. 11, 2015, 11 pages.

"U.S. Appl. No. 14/852,231 Office Action", dated Mar. 22, 2018, 14 pages.

"U.S. Appl. No. 14/260,025 Final Office Action", dated Jan. 4, 2018, 15 pages.

"Austrailian Patent Application No. 2016203129, Examination Report", dated Dec. 22, 2016, 3 pages.

"U.S. Appl. No. 14/260,025 Office Action", dated Feb. 27, 2017, 13 pages.

"Australian Application No. 2017279785 Examination Report", dated Oct. 7, 2019, 4 pages.

"Australian Application No. 2017279785 Examination Report", dated Nov. 27, 2018, 3 pages.

"U.S. Appl. No. 14/260,025 Office Action", dated Oct. 7, 2019, 16 pages.

"U.S. Appl. No. 14/852,231 Final Office Action", dated Jul. 27, 2018, 16 pages.

"Australian Application No. 2019271966 Examination Report", dated Dec. 10, 2020, 6 pages.

* cited by examiner

METHODS OF TRANSFERRING FUNDS IN A CASHLESS WAGERING SYSTEM

RELATED APPLICATIONS

This application is a continuation-in-part application that claims priority benefit of U.S. application Ser. No. 14/260,025 filed Apr. 23, 2014, which claims the priority benefit of U.S. Provisional Application Ser. No. 61/815,601 filed Apr. 24, 2013.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent tiles or records, but otherwise reserves all copyright rights whatsoever. Copyright 2014, WMS Gaming, Inc.

FIELD

Embodiments of the inventive subject matter relate generally to wagering game systems, and more particularly to cashless wagering game systems.

BACKGROUND

Cashless wagering game systems have become commonplace in casinos. Instead of currency, cashless wagering game systems utilize cash substitutes, such as tickets, player identification cards, credit cards, etc. for transactions taking place during wagering gameplay. For example, when a player cashes out at the end of a wagering game session, the wagering game machine prints a ticket representing the credit meter's cash value at the time of cash out. The player can then take the ticket and insert it in another wagering game machine and begin gameplay. Additionally, the player can exchange the ticket for cash at a cashier or kiosk. Although cashless wagering game systems have many advantages, tickets can be easily lost, misplaced, stolen, etc. before the player is able to redeem them.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention, while the second section describes example operations performed by some embodiments. The third section discusses wagering game networks, while the fourth section describes wagering game machines.

Introduction

This section provides an introduction to some embodiments of the invention.

Some embodiments of the inventive subject matter allow a player to deposit a wagering game ticket using a mobile device. For example, in some embodiments, a wagering game machine prints a wagering game ticket representing the player's credit meter balance at cash out. The wagering game ticket can include a unique identifier, such as a two-dimensional (2D) barcode, that indicates the player's player account, monetary value associated with the ticket, and other information. The player can then take a picture of the wagering game ticket with a mobile device, such a cellular telephone. The mobile device can then transmit the information contained on the wagering game ticket to a player account server. The player account server can then communicate with a ticketing server, which determines the monetary balance associated with the wagering game ticket. The player account server can then deposit the wagering game ticket (i.e., the monetary value associated with the wagering game ticket) in the player's player account.

Figure 1A:
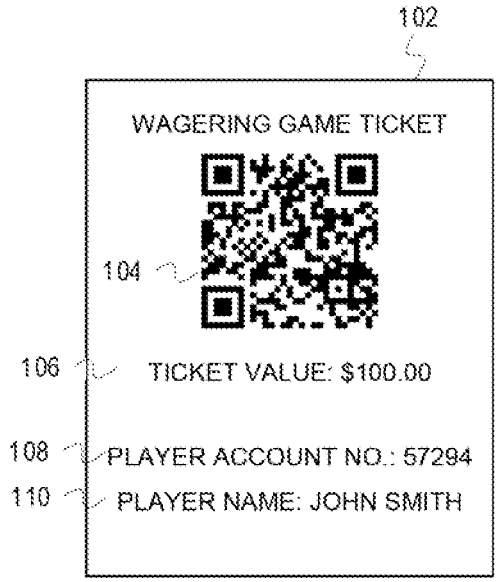
FIG. 1A depicts a wagering game ticket 102, according to some embodiments of the inventive subject matter.

FIG. 1A depicts a wagering game ticket 102, according to some embodiments of the inventive subject matter. As depicted in FIG. 1A, the wagering game ticket 102 contains a unique identifier 104, an indication of the wagering game ticket value 106, the name of the player 110 that owns the player account associated with the wagering game ticket, and the player's player account number 108. In some embodiments, the wagering game ticket 102 can contain more or less information than is depicted in FIG. 1A. For example, the wagering game ticket 102 can contain only the unique identifier 104. In some embodiments, the wagering game ticket value, player tracking information, etc. can be embedded in the unique identifier 104. Additionally, the unique identifier 104 can take any suitable form, such as a one-dimensional (1D) barcode, a 2D barcode, a unique alphabetic code, a unique numeric code, a unique alphanumeric code, etc.

Figure 1B:
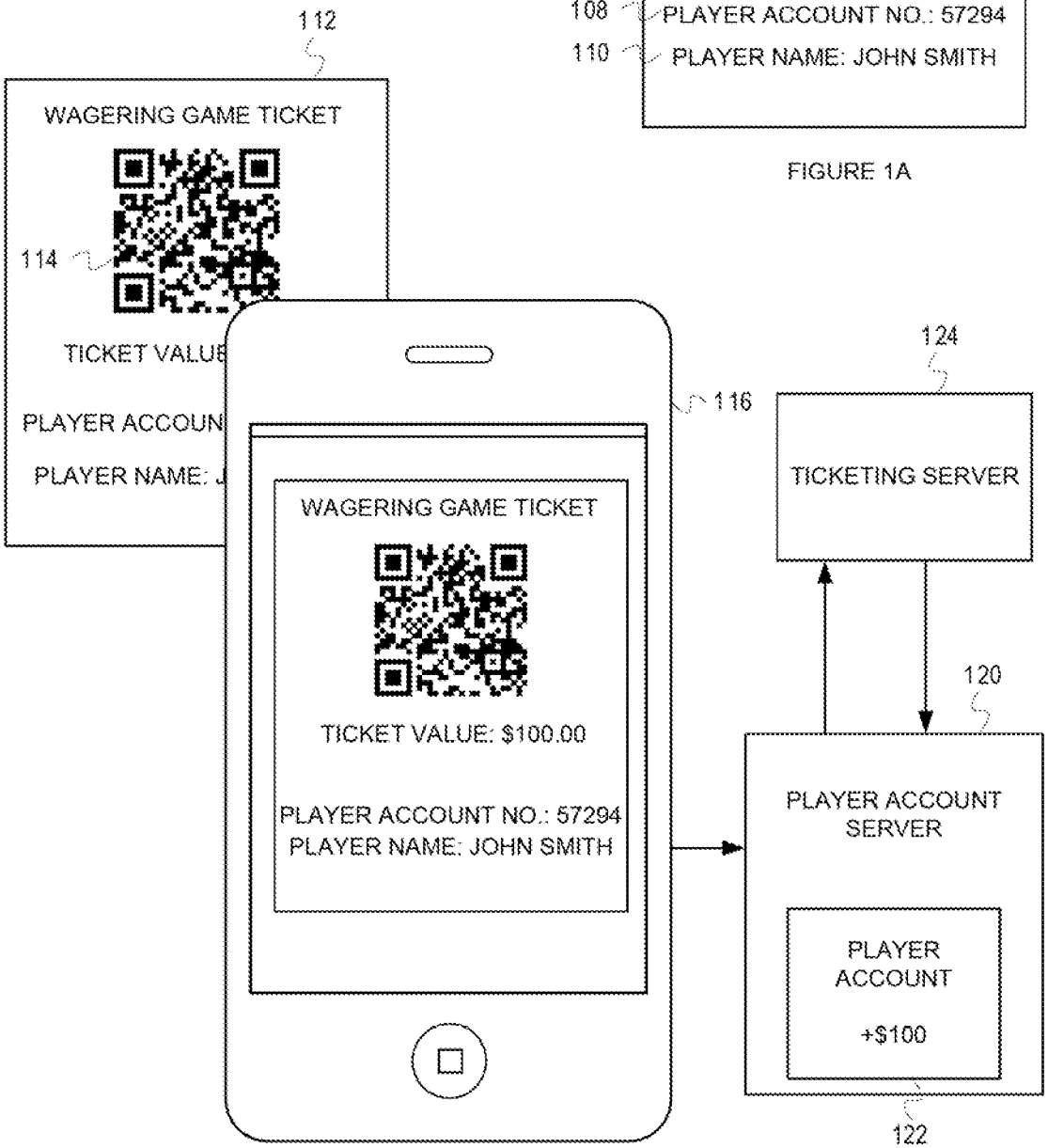
FIG. 1B depicts a mobile device 116 capturing an image of a wagering game ticket 112.

FIG. 1B depicts a mobile device 116 capturing an image of a wagering game ticket 112. After capturing the image, the mobile device 116 can transmit the image or information taken from the image to the player account server 120. The player account server 120 communicates with a ticketing server 124 to verify the monetary value associated with the wagering game ticket 112. The player account server 120 deposits the money into the player account 122.

Figure 2:
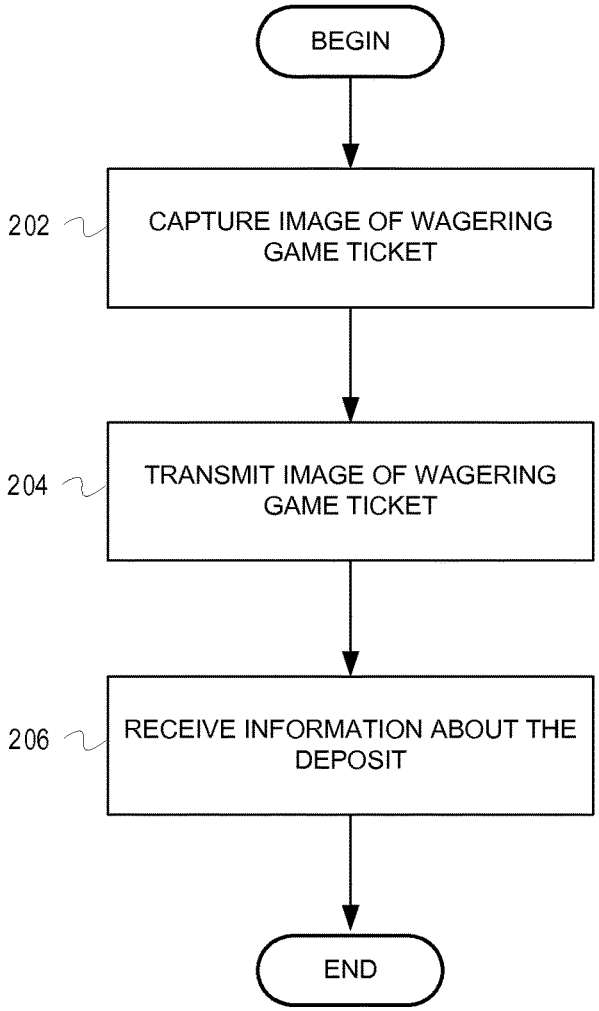
FIG. 2 is a flow diagram illustrating example operations for depositing a wagering game ticket using a mobile device, according to some embodiments of the inventive subject matter.
Figure 3:
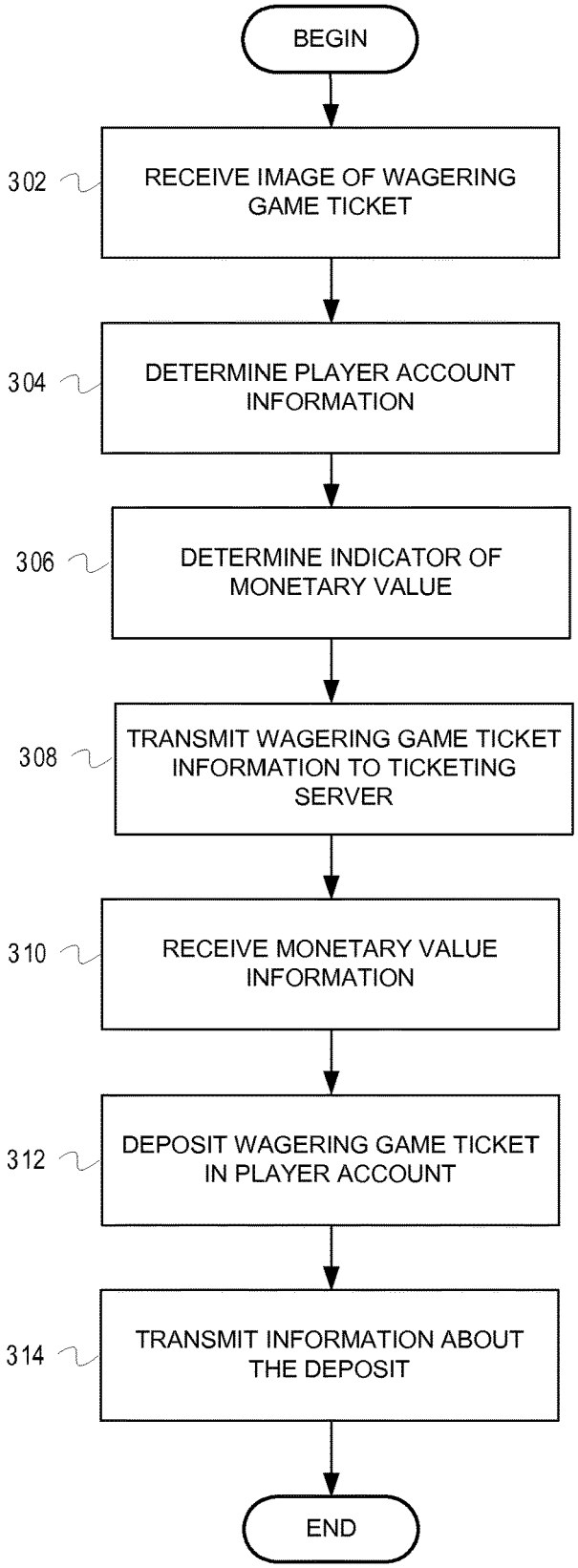
FIG. 3 is flow diagram illustrating example operations for depositing a wagering game ticket in a player account, according to some embodiments of the inventive subject matter.

As noted above, some embodiments of the mobile device 116 send the image of the wagering game ticket 112 to the player account server 120, so the player account server processes the image (see discussion of FIGS. 2 and 3). In other embodiments, the mobile device 116 itself processes the image, and then sends the pertinent information (i.e., monetary value associated with the ticket, player account number, etc.) to the player account server 120 (see discussion of FIGS. 4 and 5).

In one embodiment of the inventive subject matter, the player makes the deposit through a web browser based system. For example, the player navigates the web browser on their mobile device to a webpage associated with the player account server. Once at the webpage, the player uploads the image of the wagering game ticket (or information associated with the wagering game ticket) to the player account server. In another embodiment, the player makes the deposit through a dedicated application running on the mobile device. For example, the application can be associated with the player account server. The player can open the application, and through the application, upload the image of the wagering game ticket (or information associated with the wagering game ticket) to the player account server.

Although FIG. 1 describes some embodiments, the following sections describe many other features and embodiments.

Example Operations

This section describes operations associated with some embodiments of the invention. In the discussion below, the flow diagrams will be described with reference to the diagrams presented above. However, in some embodiments, the operations can be performed by logic not described in the diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

The section will discuss FIGS. 2-11. The discussion of FIGS. 2-5 will describe operations for processing an image of wagering game ticket and depositing the monetary value associated with the wagering game ticket in a player account. The discussion of FIGS. 6-8 will describe operations for transferring funds from a player account to a wagering game ticket. The discussion of FIGS. 9-11 will describe operations for purchasing tangible gaming instruments with funds in a player account.

FIG. 2 is a flow diagram illustrating example operations for depositing a wagering game ticket using a mobile device, according to some embodiments of the inventive subject matter. The flow begins at block 202.

At block 202, the mobile device captures an image of the wagering game ticket. In some embodiments, the player takes a picture of the wagering game ticket, and the image of the wagering game ticket is stored on the mobile device. In other embodiments, the player "scans" the wagering game ticket. In such embodiments, the image of the wagering game ticket is not saved to the mobile device. Rather, when the image appears in the mobile device's view finder, the mobile device temporarily stores image information in a camera buffer. The image is acquired by accessing the mobile device's camera buffer and retrieving the image. Furthermore, in some embodiments, it is unnecessary for the player to capture an image of the entire wagering game ticket. In such embodiments, it is only necessary for the player to capture an image of the unique identifier on the wagering game ticket. The flow continues at block 204.

At block 204, the mobile device transmits an image of the wagering game ticket to the player account server. The mobile device may transmit the image information via a wireless telephone network, a local area wireless network, or any other suitable communications network. In some embodiments, the mobile device may transmit an image of the entire wagering game ticket. In other embodiments, the mobile device may crop the image of the wagering game ticket, so that the cropped image contains only the necessary information, such as the unique identifier, player account associated with the wagering game ticket, the monetary value associated with the wagering game ticket, etc. It should also be noted that in some embodiments, the mobile device transmits the image of the wagering game ticket to a wagering game server. In such embodiments, the wagering game server communicates with the player account server to facilitate deposit of the wagering game ticket. The flow continues at block 206.

At block 206, the mobile device receives information about the deposit. For example, the mobile device can receive a confirmation that the deposit was successful.

While FIG. 2 describes embodiments in which the mobile device transmits the image of the wagering game ticket to the player account server for processing from the perspective of the mobile device, FIG. 3 describes these same embodiments from the perspective of the player account server.

FIG. 3 is flow diagram illustrating example operations for depositing a wagering game ticket in a player account, according to some embodiments of the inventive subject matter. The flow begins at block 302.

At block 302, the player account server receives the image of the wagering game ticket. In some embodiments, the player account server receives an image of the entire wagering game ticket. In other embodiments, the player account server receives an image of just some of the information on the wagering game ticket. For example, the player account server may receive only an image of the unique identifier. The flow continues at block 304.

At block 304, the player account server determines the player account information (the player account associated with the wagering game ticket). In some embodiments, the player account server determines the player account associated with the wagering game ticket from information contained on the wagering game ticket. For example, the player account server can employ optical character recognition (OCR) or other computer vision techniques to determine the name of the player or the player's player account number printed on the wagering game ticket. Additionally, the player's name or player account can be embedded in the unique identifier. In such embodiments, the player account server determines the player account associated with the wagering game ticket by scanning or processing the unique identifier. In other embodiments, a player account may not be associated with the wagering game ticket (i.e., the ticket is not issued to a particular player account). In such embodiments, the player account server can determine the player account into which the deposit should be made through other means. For example, the player may have to login to a webpage or application from the mobile device to initiate the deposit. The player account server can determine the player account into which the deposit should be made based on this login information. The flow continues at block 306.

At block 306, the player account server determines an indicator of the monetary value. In some embodiments, the unique identifier printed on the wagering game ticket contains the monetary value information. The flow continues at block 308.

At block 308, the player account server transmits the wagering game ticket information to a ticketing server. The wagering game ticket information can include an indication of the monetary value associated with the wagering game ticket, a wagering game ticket serial number, etc. In some embodiments, the ticketing server resides on the same hardware on which the player account server resides. In other embodiments, the ticketing server resides on standalone hardware. In some embodiments, the ticketing server is associated with a different business entity (e.g., company) than the entity associated with the player account server or the wagering game machine that printed the wagering game ticket. For example, a wagering game ticket may be printed from a wagering game machine associated with WMS Gaming, Inc. of Chicago, Ill., and the ticketing server may be associated with International Game Technologies (IGT) of Reno, Nev., using Ticket In/Ticket Out (TITO) technology to determine the monetary value associated with the wagering game ticket. The flow continues at block 310.

At block 310, the player account server receives the monetary value information from the ticketing server. In other words, the player account server receives an indication of the monetary value associated with the wagering game ticket. The flow continues at block 312.

At block 312, the player account server deposits the wagering game ticket in the player account. Additionally, in some embodiments, once the wagering game ticket has been deposited, the wagering game ticket can be voided, or recorded as deposited in a database to prevent the wagering game ticket from being deposited a second time. The flow continues at block 314.

At block 314, the player account server transmits information about the deposit. For example, the player account server can transmit a confirmation that the deposit was successful. Additionally, the wagering game server can transmit an indication of the current balance in the player account.

Although the discussion of FIGS. 2 and 3 describes depositing a wagering game ticket in a specific player account, embodiments are not so limited. For example, a player may not have a player account or may not want a wagering game ticket deposited in his/her player account. In such embodiments, the wagering game server can perform functions similar to those of the player account server. For example, the wagering game server creates a temporary account for the player. The wagering game server creates the temporary account when the player begins a wagering game session (or deposits the wagering game ticket) and exists for the duration of the wagering game session. Although the temporary account is not linked to the player, the wagering game server links the temporary account to the mobile device or a wagering game machine. For example, the wagering game server can link the temporary account to a unique identifier of the mobile device (e.g., a MAC address, and IP address, etc.) or a unique identifier of the wagering game machine. When the mobile device transmits the image of the wagering game ticket, the wagering game server deposits the wagering game ticket in the temporary account. The wagering game server updates a balance of the temporary account as the player plays wagering games during the wagering game session. When the player terminates the wagering game session (e.g., cashes out), the temporary account is closed and the balance of the temporary account is removed (e.g., by creating a new wagering game ticket). As described in more detail in the discussion of FIGS. 15-17, an e-ticket can be created when the player cashes out.

Figure 4:
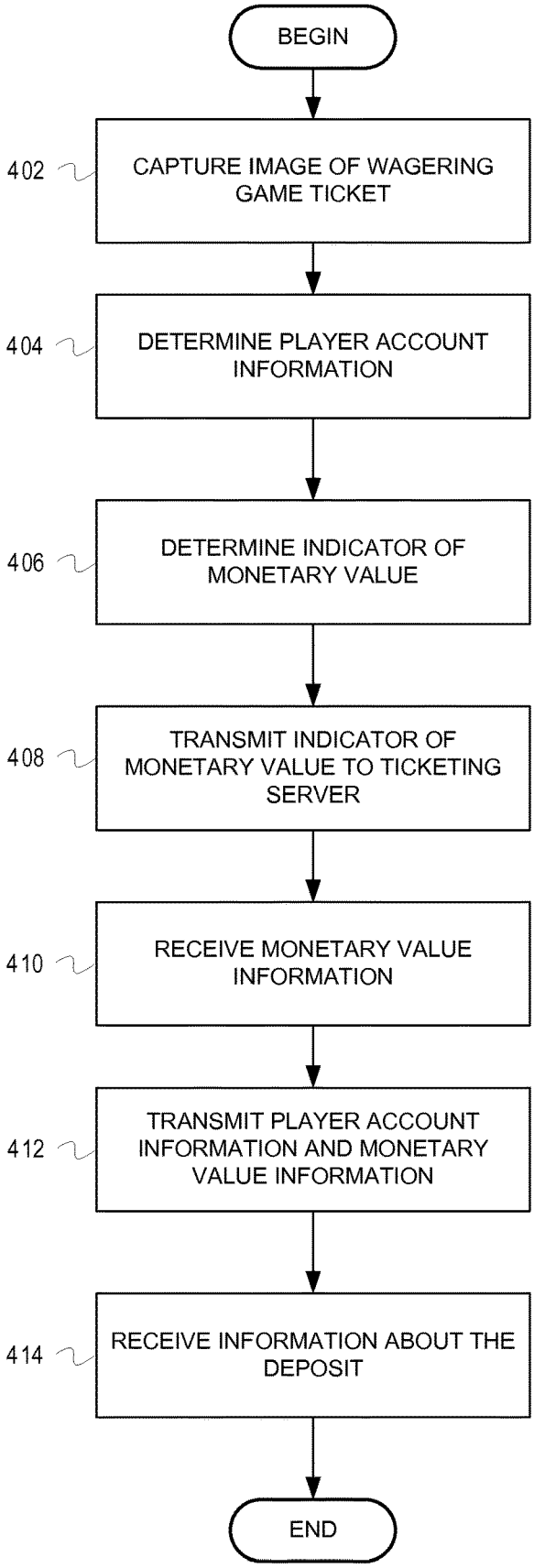
FIG. 4 is a flow diagram illustrating example operations for depositing a wagering game ticket using a mobile device, according to some embodiments of the inventive subject matter.

In FIGS. 2 and 3, as part of the process for depositing a ticket into a player account, the player account server processes the ticket image. However, in some embodiments, the mobile phone can process the image (e.g., by applying OCR to determine the ticket value, etc.). FIGS. 3 and 4 describe operations for depositing a ticket into a player account, where the mobile phone processes the image.

FIG. 4 is a flow diagram illustrating example operations for depositing a wagering game ticket using a mobile device, according to some embodiments of the inventive subject matter. The flow begins at block 402.

At block 402, the mobile device captures an image of the wagering game ticket. In some embodiments, a player takes a picture of the wagering game ticket, and the image of the wagering game ticket is stored on the mobile device. In other embodiments, the player "scans" the wagering game ticket. In such embodiments, the image of the wagering game ticket is not saved to the mobile device. Rather, the image is acquired by accessing the mobile device's camera buffer and retrieving the image. As a player points the camera at a ticket, the image appears in the mobile device's view finder. Images in the camera's viewfinder are temporarily represented in a camera buffer of the mobile phone. Embodiments can access images in the camera buffer even though a picture has not been taken. In some embodiments, it is unnecessary for the player to capture an image of the entire wagering game ticket. In such embodiments, it is only necessary for the player to capture an image of the unique identifier on the wagering game ticket. The flow continues at block 404.

At block 404, the mobile device determines the player account information (the player account associated with the wagering game ticket). In some embodiments, the mobile device determines the player account associated with the wagering game ticket from information contained on the wagering game ticket. For example, the mobile device can employ OCR or other computer vision techniques to determine the player's name or the player's player account number printed on the wagering game ticket. Additionally, the player's name or player account can be embedded in the unique identifier. In such embodiments, the mobile device determines the player account associated with the wagering game ticket by scanning or processing the unique identifier. In other embodiments, a player account may not be associated with the wagering game ticket (i.e., the ticket is not issued to a particular player account). In such embodiments, the mobile device can determine the player account into which the deposit should be made through other means. For example, the player may have to login to a webpage or application from the mobile device to initiate the deposit. The mobile device can determine the player account into which the deposit should be made based on this login information. The flow continues at block 406.

At block 406, the mobile device determines the indicator of the monetary value. In some embodiments, the unique identifier printed on the wagering game ticket contains the monetary value information. The flow continues at block 408.

At block 408, the mobile device transmits the indicator of the monetary value to a ticketing server. The ticketing server, using the indicator of the monetary value, determines the monetary value associated with the wagering game ticket (the monetary value information). The flow continues at block 410.

At block 410, the mobile device receives the monetary value information from the ticketing server. In other words, the mobile device receives an indication of the monetary value associated with the wagering game ticket. The flow continues at block 412.

At block 412, the mobile device transmits the player account information and the monetary value information to the player account server. This transmission may be achieved by any suitable means, both wired and wireless. For example, the mobile device can communicate with the player account server via a cellular telephone network, Wi-Fi network, etc. Additionally, in some embodiments, the mobile device may also transmit an image of the wagering game ticket (or unique identifier) to the player account server. In such embodiments, the player account server can maintain images of the deposited wagering game tickets, log transaction information pertaining to the wagering game tickets, etc. The flow continues at block 414.

At block 414, the mobile device receives information about the deposit from the player account server. For example, the mobile device can receive a confirmation that the deposit was successful.

Figure 5:
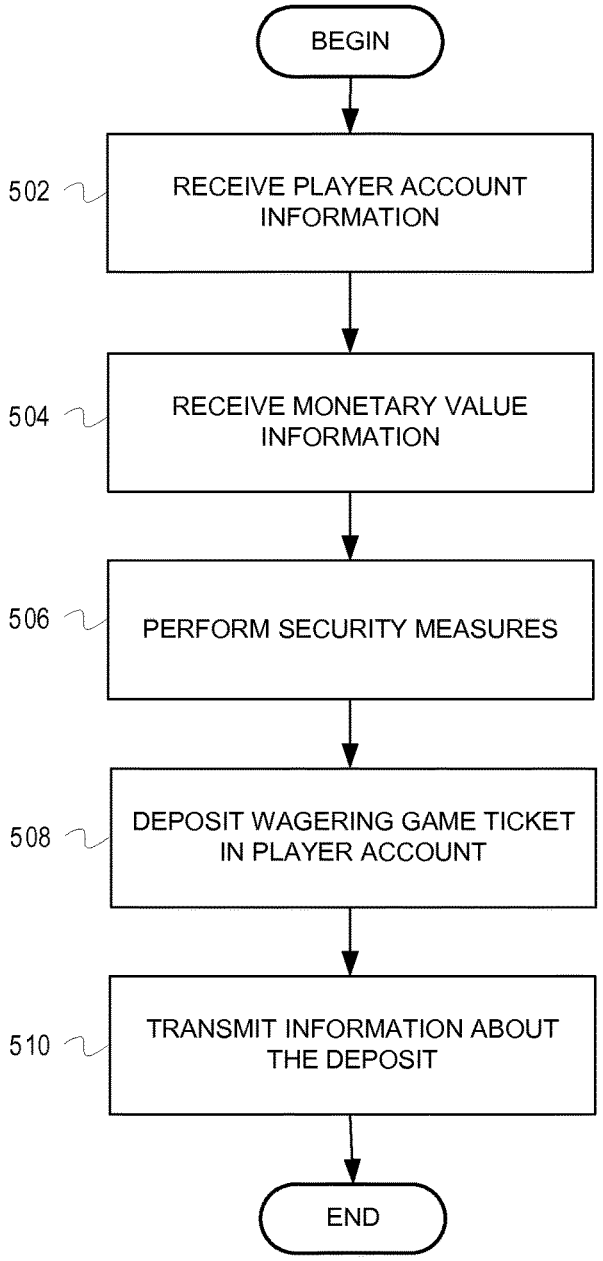
FIG. 5 is flow diagram illustrating example operations for depositing a wagering game ticket in a player account, according to some embodiments of the inventive subject matter.

While FIG. 4 describes embodiments where the mobile device processes the image of the wagering game ticket and sends the relevant information to the player account server, FIG. 5 describes complimentary operations performed by embodiments of the player account server.

FIG. 5 is flow diagram illustrating example operations for depositing a wagering game ticket in a player account, according to some embodiments of the inventive subject matter. The flow begins at block 502.

At block 502, the player account server receives player account information. The player account server can receive this information via any suitable wired or wireless means. The flow continues at block 504.

At block 504, the player account server receives the monetary value information. The player account server can receive this information via any suitable wired or wireless means. The flow continues at block 506.

At block 506, the player account server performs security measures. In some embodiments, the player account server can verify the information received in a database. For example, the player account server can search a database of all issued wagering game tickets. The database can contain information about each issued wagering game ticket, such as the player account to which the wagering game ticket was issued, the monetary value associated with the wagering game ticket, whether the wagering game ticket has been previously deposited, etc. In some embodiments, a portion of this information may reside on the ticketing server. For example, the monetary value associated with the wagering game ticket, a wagering game ticket serial number, etc. may reside on the ticketing server. In such embodiments, the player account server can interact with the ticketing server to perform security measures. Upon searching the database and/or interacting with the ticketing server, if the player account server determines that the ticket is fraudulent, has already been deposited, etc., the player account server can refuse to make the deposit. In some embodiments, the player account server can relay the monetary value information received from the mobile device to the ticketing server for verification. The flow continues at block 508.

At block 508, the player account server deposits the wagering game ticket in the player account. As previously discussed, if the player account server determines that the wagering game ticket is fraudulent or otherwise invalid, the player account server can refuse to make the deposit. Additionally, in some embodiments, once the wagering game ticket has been deposited, the wagering game ticket can be voided, or recorded in the database as deposited to prevent the wagering game ticket form being deposited a second time. The flow continues at block 510.

At block 510, the player account server transmits information about the deposit. For example, the player account server can transmit a confirmation that the deposit was successful. Additionally, the player account server can transmit an indication of the current balance in the player account.

Figure 6:
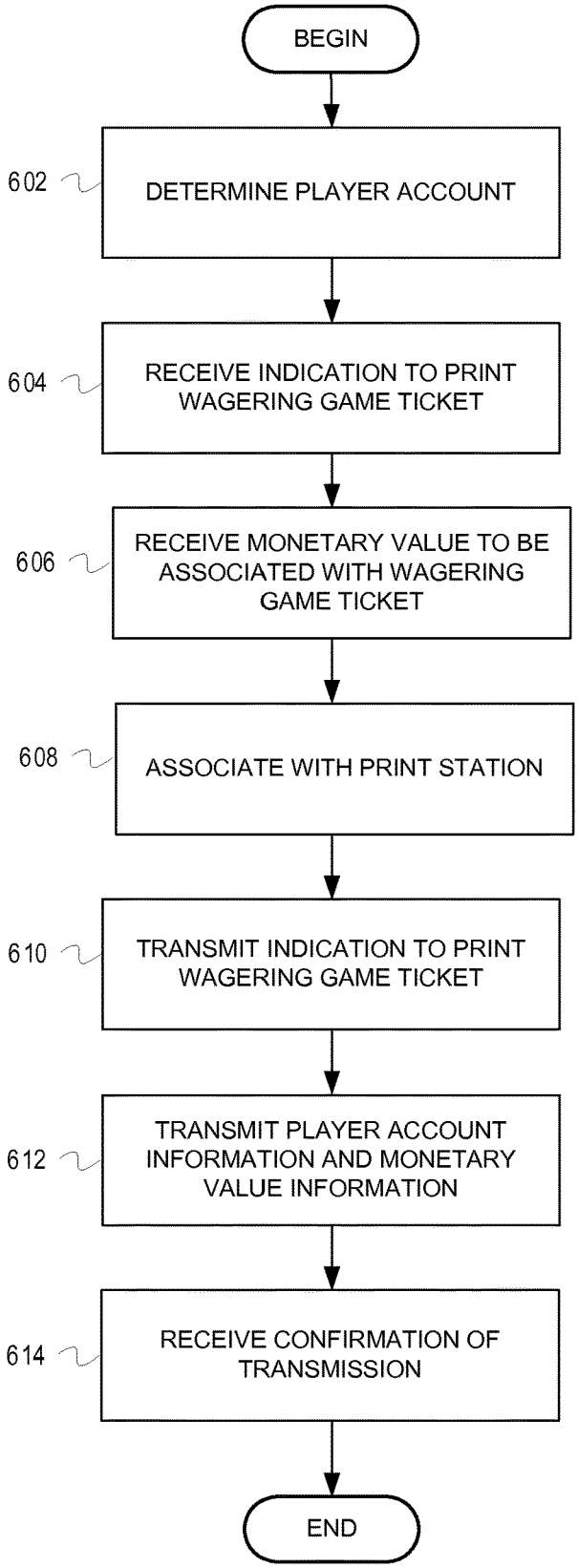
FIG. 6 is a flow diagram illustrating example operations for transferring funds from a player account to a wagering game ticket using a mobile device, according to some embodiments of the inventive subject matter.
Figure 7:
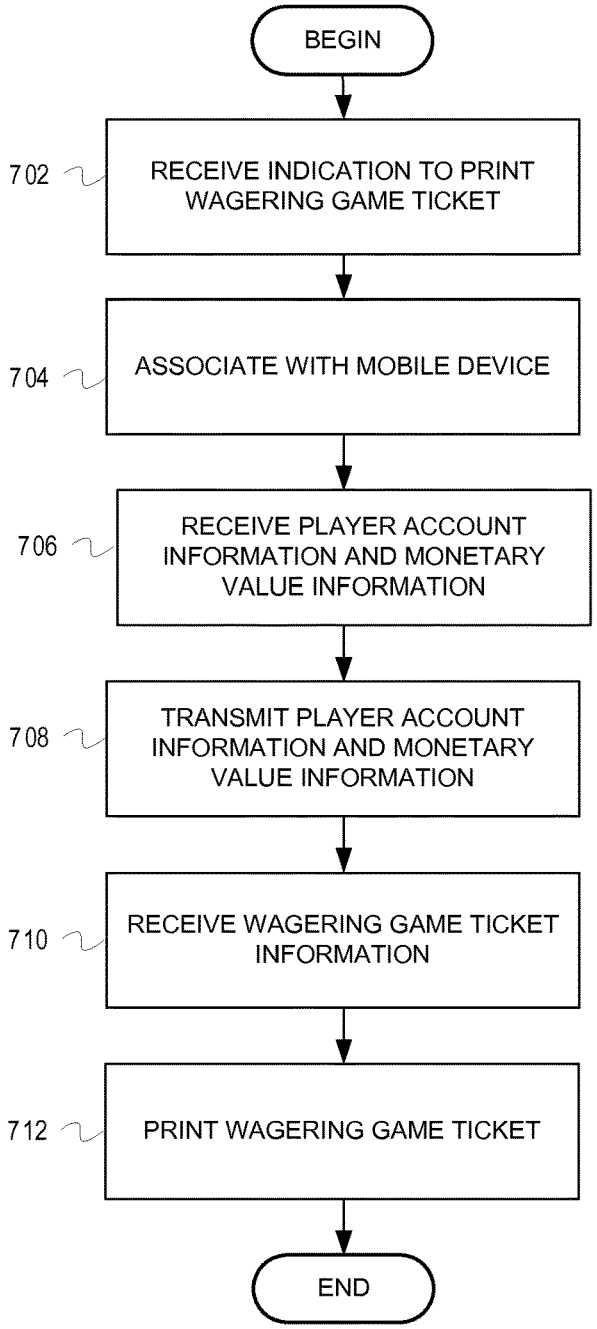
FIG. 7 is a flow diagram illustrating example operations for transferring funds from a player account to a wagering game ticket, according to some embodiments of the inventive subject matter.
Figure 8:
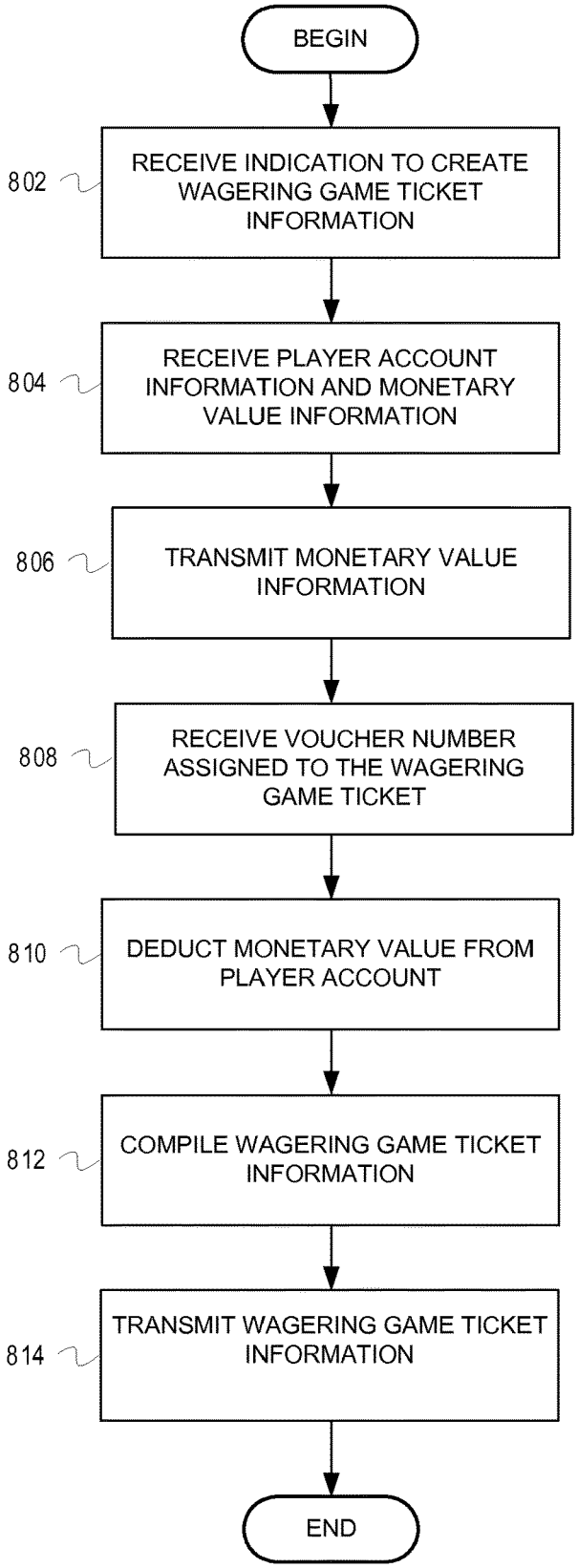
FIG. 8 is a flow diagram illustrating example operations for transferring funds from a player account to a wagering game ticket, according to some embodiments of the inventive subject matter.

While FIGS. 2-5 describe operations for processing an image of wagering game ticket and depositing the monetary value associated with the wagering game ticket in a player account, FIGS. 6-8 describe operations for transferring funds from a player account to a wagering game ticket. In some embodiments, transferring funds from a player account to a wagering game ticket requires action by three components: a mobile device, a print station, and a player account server. In broad terms, the mobile device communicates with the print server, indicating a desire to print a wagering game ticket. The print server communicates with the player account server to facilitate that transfer of funds from the player account. The player account server withdraws the funds from the player account to be associated with the wagering game ticket. Finally, after all relevant information is received from the mobile device and the player account server, the print station prints the wagering game ticket.

FIG. 6 is a flow diagram illustrating operations for transferring funds from a player account to a wagering game ticket using a mobile device, according to some embodiments of the inventive subject matter. The flow begins at block 602.

At block 602, the mobile device determines a player account from which to transfer funds. In some embodiments, the player is required to login to a webpage or application on the mobile device to transfer funds from their player account to a wagering game ticket. In such embodiments, the mobile device can determine the player account based on the login credentials. The flow continues at block 604.

At block 604, the mobile device receives an indication to print (e.g., on a nearby print station) a wagering game ticket representing funds transferred from the player account to the wagering game ticket. In some embodiments, the player can indicate a desire to print a wagering game ticket via a website associated with the player account server or using an application associated with the player account server. The flow continues at block 606.

At block 606, the mobile device receives an indication of the monetary value to be associated with the wagering game ticket. In some embodiments, the player can indicate the amount to be transferred from their player account to the wagering game ticket via a website associated with the player account server or using an application associated with the player account server. The flow continues at block 608.

At block 608, the mobile device associates with a print station which will print the wagering game ticket. In some embodiments, this association is necessary in order ensure that the wagering game ticket will be printed at the correct print station and to prevent fraud. The mobile device can associate with the print station using any suitable means. In some embodiments, the print station may communicate with the mobile device wirelessly, for example, over a near field communications (NFC) network. For example, the print station may request that the mobile device emit an encoded audio signal to verify the mobile device's proximity with the print station. Alternatively, the print station may have a unique identifier associated with it that must be entered on the mobile device to associate with the print station. For example, the print station may have a barcode that the mobile device must scan, or may have a unique code printed on it that must be entered on the mobile device. In some embodiments, the mobile device prompts the player to associate with the print station. In other embodiments, the association may happen automatically. The flow continues at block 610.

At block 610, the mobile device transmits an indication to print the wagering game ticket to the print station. This transmission may be achieved by any suitable means, both wired and wireless. The flow continues at block 612.

At block 612, the mobile device transmits the player account information and the monetary value information to the print station. This transmission may be achieved by any suitable means, both wired and wireless. The flow continues at block 614.

At block 614, the mobile device receives confirmation of the transmission. In some embodiments, the mobile device receives confirmation from the print station that the transmission of the indication to print the wagering game ticket and the transmission of the player account information and monetary value information was successful. In some embodiments, the mobile device receives this confirmation after the transmissions have been made to the print station. In other embodiments, the mobile device receives this confirmation after the transmissions have been passed from the print station to a player account server which processes the transaction. For example, the print station can confirm that the transmissions were successfully passed to the player account server.

While FIG. 6 describes transferring funds from a player account to a wagering game ticket from the perspective of the mobile device, FIG. 7 describes transferring funds from a player account to a wagering game ticket from the perspective of the print server.

FIG. 7 is a flow diagram illustrating example operations for transferring funds from a player account to a wagering game ticket, according to some embodiments of the inventive subject matter. The flow begins at block 702.

At block 702, the print station receives an indication to print a wagering game ticket. In some embodiments, this indication is received from the mobile device. The flow continues at block 704.

At block 704, the print station associates with the mobile device. The print station can associate with the mobile device via any suitable means, and can either associate automatically or prompt player input for the association. For example, the print station can require player input at the print station or can require player input at the mobile device. In some embodiments, the print station associates with the mobile device wirelessly. In other embodiments, the print station associates with the mobile device when the mobile device is physically connected to the print station. The flow continues at block 706.

At block 706, the print station receives player account information and monetary value information. In some embodiments, the print station receives player account information and monetary value information from the mobile device. In other embodiments, the print station receives the player account information via player input at the print station. The player account information indicates the player account from which funds should be withdrawn. The monetary value information indicates the amount of funds to be withdrawn from the player account and transferred to the wagering game ticket. The flow continues at block 708.

At block 708, the print station transmits the player account information and the monetary value information to the player account server. This transmission can be achieved through any suitable means, both wired and wireless. The flow continues at block 710.

At block 710, the print server receives wagering game ticket information from the player account server. In some embodiments, the wagering game ticket information includes all information necessary to print the wagering game ticket representing the funds transferred from the player account to the wagering game ticket. For example, the wagering game ticket can include an indication of the player account from which the funds were transferred as well as an indication of the monetary value associated with the wagering game ticket. Alternatively, the wagering game ticket may be associated with a player account separate from the player account from which the funds were transferred. For example, Player A may wish to transfer funds from their player account to a wagering game ticket associated with their friend, Player B. The wagering game ticket will then be associated with Player B (i.e., only Player B will be able to access the monetary value associated with the wagering game ticket), but the monetary value associated with the wagering game ticket will have come from funds in Player A's player account. In some embodiments, the wagering game ticket information is only the monetary value associated with the wagering game ticket (i.e., the wagering game ticket is not associated with a specific player). In other embodiments, the wagering game ticket contains more information than the monetary value and the player account. For example, the wagering game ticket can include any type of information, such as a wagering game ticket number, time and date information, etc. The flow continues at block 712.

At block 712, the print station prints the wagering game ticket. In some embodiments, the wagering game ticket is printed with all of the wagering game ticket information received by the print station. In other embodiments, the wagering game ticket is printed with more or less information than is received by the print station.

While FIG. 7 describes operations from the perspective of the print server, FIG. 8 describes transferring funds from a player account to a wagering game ticket from the perspective of the player account server.

FIG. 8 is a flow diagram illustrating example operations for transferring funds from a player account to a wagering game ticket, according to some embodiments of the inventive subject matter. The flow begins at block 802.

At block 802, the player account server receives and indication to create wagering game ticket information. In some embodiments, this indication is received from the print station. In other embodiments, this indication is received from the mobile device. The flow continues at block 804.

At block 804, the player account server receives the player account information and the monetary value information. The player account information instructs the player account server to withdraw the monetary value from a specific player account. The monetary value information informs the player account server of the amount of funds to withdraw from the player account and associate with the wagering game ticket. The flow continues at bock 806.

At block 806, the player account server transmits the monetary value information to a ticketing server. The ticketing server assigns a voucher number to the wagering game ticket. The voucher number is associated with the wagering game ticket, and thus reflects the monetary value associated with the wagering game ticket. This voucher number allows the wagering game ticket to be used in a cashless wagering game system. In some embodiments, the ticketing server resides on the same hardware as the player account server. In other embodiments, the ticketing server resides on hardware distinct from that of the player account server. In some embodiments, the player account server and the ticket server are associated with separate or distinct entities. The flow continues at block 808.

At block 808, the player account server receives the voucher number assigned to the wagering game ticket from the ticketing server. This voucher number allows the wagering game ticket to be used in a cashless wagering game system. The flow continues at block 810.

At block 810, the player account server compiles the wagering game ticket information. In some embodiments, the wagering game ticket information includes only the voucher number assigned to the wagering game ticket. In other embodiments, the wagering game information includes more data. For example, the wagering game ticket information can include the player account from which the funds were transferred, a wagering game ticket number, date and time information, etc. The flow continues at block 812.

At block 812, the player account server transmits the wagering game ticket information to the print station, so the print station can print the ticket. This transmission can be achieved by any suitable means, both wired and wireless.

Figure 9:
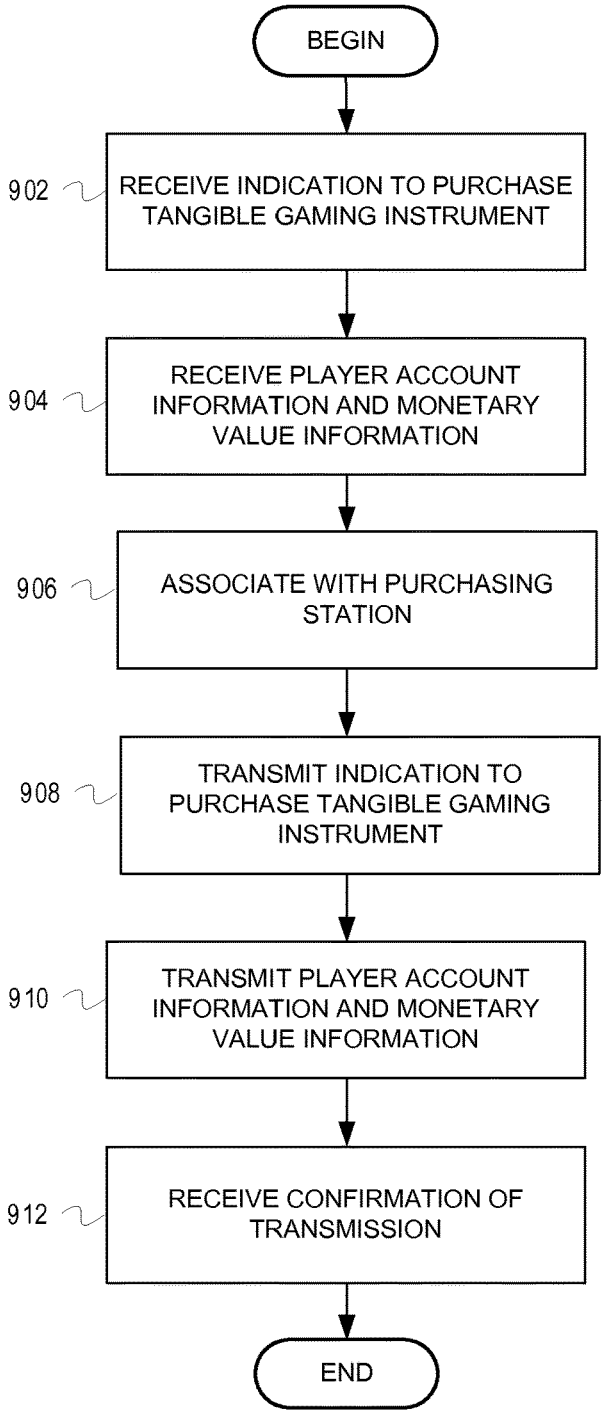
FIG. 9 is a flow diagram illustrating example operations for purchasing tangible gaming instruments with funds in a player account using a mobile device, according to some embodiments of the inventive subject matter.
Figure 10:
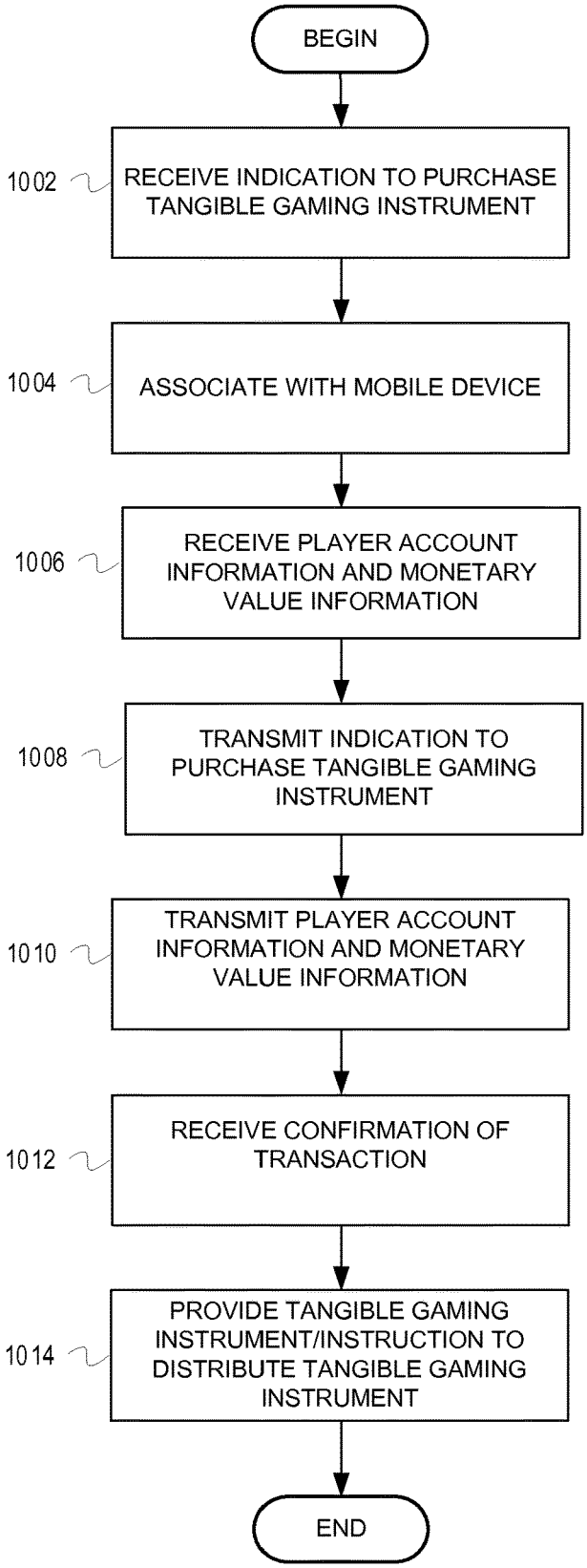
FIG. 10 is a flow diagram illustrating example operations for purchasing tangible gaming instruments with funds in a player account, according to some embodiments of the inventive subject matter.
Figure 11:
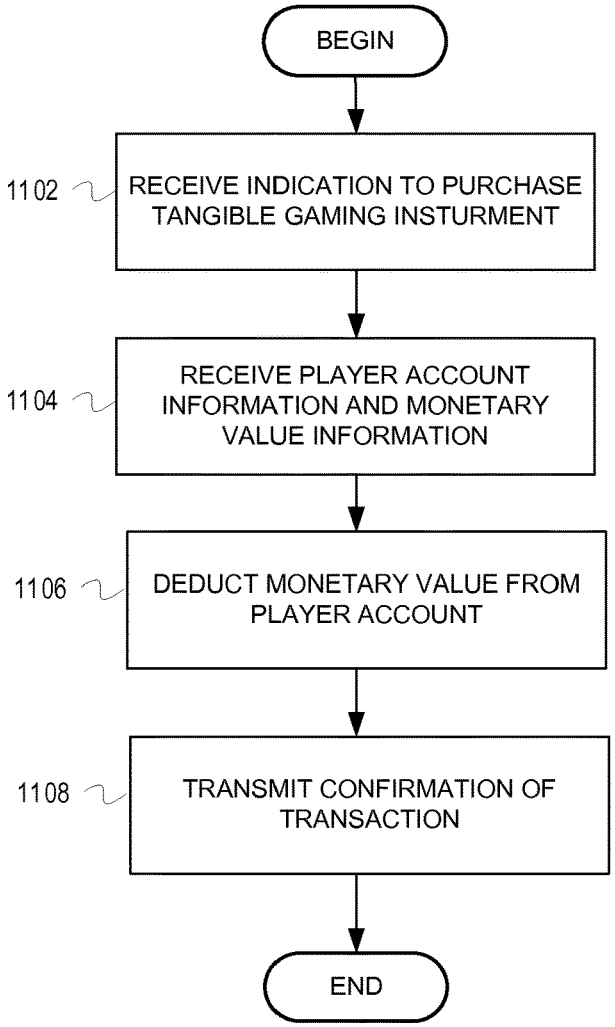
FIG. 11 is a flow diagram illustrating example operations for purchasing tangible gaming instruments with funds in a player account, according to some embodiments of the inventive subject matter.

While FIGS. 6-8 describe transferring funds from a player account to a wagering game ticket, FIGS. 9-11 describe using funds in a player account to purchase tangible wagering game instruments, such as chips.

FIG. 9 is a flow diagram illustrating example operations for purchasing tangible gaming instruments with funds in a player account using a mobile device, according to some embodiments of the inventive subject matter. The flow begins at block 902.

At block 902, the mobile device receives an indication to purchase a tangible gaming instrument using funds in a player account. For example, a player may wish to purchase chips for play at a table wagering game such as poker, roulette, etc. The player can use their mobile device to access their player account and use money in their player account to fund the purchase of chips. The flow continues at block 904.

At block 904, the mobile device receives player account information and monetary value information. The player account information allows funds to be withdrawn from the correct player account. The monetary value information indicates the amount of money from the player account to be used to fund the purchase of chips, or other tangible gaming instrument. In some embodiments, the player logs in on the mobile device using a web browser or dedicated application running on the mobile device. In such embodiments, the mobile device can obtain the player account information from the login credentials. In some embodiments, the player enters, on the mobile device, the monetary value they wish to utilize to purchase chips. The flow continues at block 906.

At block 906, the mobile device associates with a purchasing station. In some embodiments, the purchasing station acts as an intermediary between the mobile device and the player account server. Additionally, in some embodiments, the purchasing station can act as a verification mechanism for the casino employee distributing chips or other tangible wagering game instruments. The mobile device can associate with the purchasing station using any suitable means. In some embodiments, the purchasing station may communicate with the mobile device wirelessly, for example, over a near field communications (NFC) network. For example, the purchasing station may request that the mobile device emit an encoded audio signal to verify the mobile device's proximity with the purchasing station. Alternatively, the purchasing station may have a unique identifier associated with it that must be entered on the mobile device to associate with the purchasing station. For example, the purchasing station may have a barcode that the mobile device must scan, or may have a unique code printed on it that must be entered on the mobile device. In some embodiments, the mobile device prompts the player to associate with the purchasing station. In other embodiments, the association may happen automatically. The flow continues at block 908.

At block 908, the mobile device transmits an indication to purchase tangible gaming instruments to the purchasing station. This transmission may be achieved by any suitable means, both wired and wireless. The flow continues at block 910.

At block 910, the mobile device transmits player account information and monetary value information to the purchasing station. The player account information indicates the player account from which to draw funds to purchase the tangible gaming instruments. The monetary value information indicates the value of the tangible gaming instruments to be purchased. This transmission may be achieved by any suitable means, both wired and wireless. The flow continues at block 912.

At block 912, the mobile device receives confirmation of the transmissions. For example, the purchasing station or player account server can communicate with the mobile device indicating that the transmissions were successful.

While FIG. 9 describes operations from the perspective of the mobile device, FIG. 10 describes operations for purchasing tangible wagering game instruments from the perspective of the purchasing station.

FIG. 10 is a flow diagram illustrating example operations for purchasing tangible gaming instruments with funds in a player account, according to some embodiments of the inventive subject matter. The flow begins at block 1002.

At block 1002, the purchasing station receives an indication to purchase tangible gaming instruments from the mobile device. This transmission may be achieved by any suitable means, both wired and wireless. The flow continues at block 1004.

At block 1004, the purchasing station associates with the mobile device. The purchasing station can associate with the mobile device via any suitable means, and can either associate automatically or prompt player input for the association. For example, the purchasing station can require player input at the purchasing station or can require player input at the mobile device. In some embodiments, the purchasing station associates with the mobile device wirelessly. In other embodiments, the purchasing station associates with the mobile device when the mobile device is physically connected to the purchasing station. The flow continues at block 1006.

At block 1006, the purchasing station receives player account information and monetary value information from the mobile device. This transmission may be achieved by any suitable means, both wired and wireless. The flow continues at block 1008.

At block 1008, the purchasing station transmits and indication to purchase tangible gaming instruments to the player account server. This transmission may be achieved by any suitable means, both wired and wireless. The flow continues at block 1010.

At block 1010, the purchasing station transmits player account information and monetary value information to the player account server. This transmission may be achieved by any suitable means, both wired and wireless. The flow continues at block 1012.

At block 1012, the purchasing station receives confirmation of the transaction. For example, the purchasing station can receive an indication from the player account server that the player account server has received the transmissions and successfully withdrawn the monetary value from the player account. The flow continues at block 1014.

At block 1014, the purchasing station provides that tangible gaming instruments to the player. However, in some embodiments, the purchasing station may not physically provide the player with the tangible gaming instruments. Rather, the print station provides an instruction to a casino employee to distribute tangible gaming instruments to the player. Additionally, in some embodiments, the purchasing station prints a voucher representing the tangible gaming instruments purchased. The player can then exchange the voucher for tangible gaming instruments.

While FIG. 10 describes using funds in a player account to purchase tangible wagering game instruments from the perspective of the purchasing station, FIG. 11 describes using funds in a player account to purchase tangible wagering game instruments from the perspective of the player account server.

FIG. 11 is a flow diagram illustrating example operations for purchasing tangible gaming instruments with funds in a player account, according to some embodiments of the inventive subject matter. The flow begins at block 1102.

At block 1102, the player account server receives the indication to purchase tangible gaming instruments. In some embodiments, the player account server receives the indication from the mobile device. In other embodiments, the player account server receives the indication from the purchasing station. The indication can be sent by any suitable means, both wired and wirelessly. The flow continues at block 1104.

At block 1104, the player account server receives the player account information and monetary value information. The player account information indicates the player account from which the funds to purchase the tangible gaming instruments should be withdrawn. The monetary value information indicates the amount of the funds to be withdrawn. The flow continues at block 1106.

At block 1106, the player account server deducts the monetary value from the player account. The flow continues at block 1106.

At block 1106, the player account server transmits confirmation of the transaction. In some embodiments, the player account server transmits to the mobile device, purchasing station, or both, an indication that the transaction was successful.

Although examples refer to a player depositing the wagering game ticket associated with their player account into their own player account, in some embodiments, players can deposit wagering game tickets associated with another player's player account in their own player account. For example, Player A is playing a wagering game on a wagering game machine. At the end of the wagering game session, Player A cashes out and receives a wagering game ticket that is associated with Player A's player account. Player A wishes to give this wagering game ticket to Player B so that Player B can deposit the wagering game ticket in Player B's player account. When Player B attempts to deposit the wagering game ticket, the mobile device and/or player account server can determine that the wagering game ticket is associated with a player account that is not Player B's player account. The mobile device and/or player account server can then send an authorization code via email, SMS, MMS, etc. to Player A, and alert Player A that Player B is attempting to deposit the wagering game ticket in Player B's player account. If Player A authorizes this deposit, Player A can provide Player B with the authorization number provided by the mobile device or the player account server. Player B can then enter the authorization number, and the mobile device and/or player account server will continue with the deposit.

Although examples refer to capturing an image of the wagering game ticket, in some embodiments, the mobile device may already have an image of the wagering game ticket stored in its memory. For example, the mobile device can prompt the player to provide and image of the wagering game ticket. The mobile device can provide the player with the option to either take a picture of the wagering game ticket or use an existing image of the wagering game ticket. If the player chooses to use an existing image of the wagering game ticket, the mobile device can either process the existing image of the wagering game ticket or transmit the existing image of the wagering game ticket to the wagering game server.

Although examples refer to either the mobile device processing the image of the wagering game ticket or the player account server processing the image of the wagering game ticket, in some embodiments both the mobile device and the player account server can process the image of the wagering game ticket. In such embodiments, the mobile device can process the image of the wagering game ticket and transmit the information obtained from the wagering game ticket as well as the image of the wagering game ticket. Then player account server can then process the image of the wagering game ticket. The mobile device, player account server, or both, can then compare the information obtained by each entity to ensure accuracy.

Although examples refer to scanning and processing the wagering game ticket in the casino, in some embodiments, players may be able to deposit wagering game tickets from anywhere that the player account server can be accessed. For example, in some embodiments, players can use a mobile device to capture an image of a wagering game ticket at their home. The player can then connect to the player account server through the internet and either upload the image of the wagering game ticket or upload the information relating to the wagering game ticket to the player account server.

Although examples refer to performing security measures by accessing a database containing information related to printed wagering game tickets, in some embodiments, a password of other key may be linked with the wagering game ticket to enforce security. For example, in some embodiments, before the wagering game ticket is printed, the player can enter a password to be associated with the wagering game ticket. When the wagering game ticket is redeemed (e.g., deposited via a mobile device, presented to a cashier, inserted into a wagering game machine, etc.), the player is prompted to enter the password associated with the wagering game ticket. When the player enters the password correctly, the transaction can proceed. In other embodiments, a password or key may be assigned to the wagering game ticket at the time of printing by the wagering game machine, player account server, etc., and the password or key provided to the player. In other embodiments, at the time of printing, the wagering game machine printing the wagering game ticket can create an association between the wagering game ticket and the player's mobile device. For example, the wagering game machine can communicate with the player's mobile device via a near field communication (NFC) network (or by other suitable means). The wagering game machine can request an identification number from the mobile device. The mobile device's identification number can be associated with the wagering game ticket. When a player attempts to deposit the wagering game ticket via their mobile device, the player's mobile device's identification number will be referenced with the identification number of the mobile device associated with the wagering game ticket. Additionally, in some embodiments, when the wagering game ticket is inserted into another wagering game machine, in order for the funds associated with the wagering game ticket to be accessed, the wagering game machine will communicate with the player's mobile device to ensure that the wagering game ticket is being utilized by the same player that printed the wagering game ticket.

Although examples refer to security measures to ensure that a player seeking to utilize a wagering game ticket is authorized to utilize the wagering game ticket, in some embodiments, player-imposed restrictions may be set at the time of printing the wagering game ticket to limit the use of the wagering game ticket. For example, a player may indicate at the time of printing the wagering game ticket that the wagering game ticket is for deposit only (i.e., the wagering game ticket cannot be redeemed for cash, redeemed for wagering game play on wagering game machines, etc.). Further, the player may indicate that the wagering game ticket is for deposit only in a specific player account (i.e., the wagering game ticket can only be deposited in Player A's player account). Additionally, a player may indicate that the wagering game ticket cannot be redeemed for a predetermined period of time. For example, the player can indicate that the wagering game ticket cannot be redeemed during the subsequent two hours to enforce a break from gaming.

Although examples refer to a mobile device communicating with a print kiosk to print a wagering game ticket, in some embodiments the mobile device communicates with a player account server, and the player account server communicates with the print kiosk. For example, a player can indicate a request to print a wagering game ticket via the mobile device. The mobile device will forward this request to the player account server. The player account server will then verify that the player account has funds sufficient to fulfill the request. In some embodiments, the player account server will communicate with a ticketing server to receive a barcode, ticket number, or other ticket identifier that indicates a monetary value associated with the wagering game ticket. The player account server will then transmit all necessary information (e.g., player account information, ticket identifier, etc.) to the print kiosk for printing of the wagering game ticket.

Although examples refer to monetary value being associated with a wagering game ticket, in some embodiments non-monetary value can be associated with a wagering game ticket. For example, player reward points can be associated with a wagering game ticket. In such embodiments, a player can deposit the player reward points in a player account using the techniques described herein.

Operating Environment

This section describes an example operating environment and presents structural aspects of some embodiments. This section includes discussion about wagering game networks and wagering game machine architectures.

Wagering Game Networks

Figure 12:
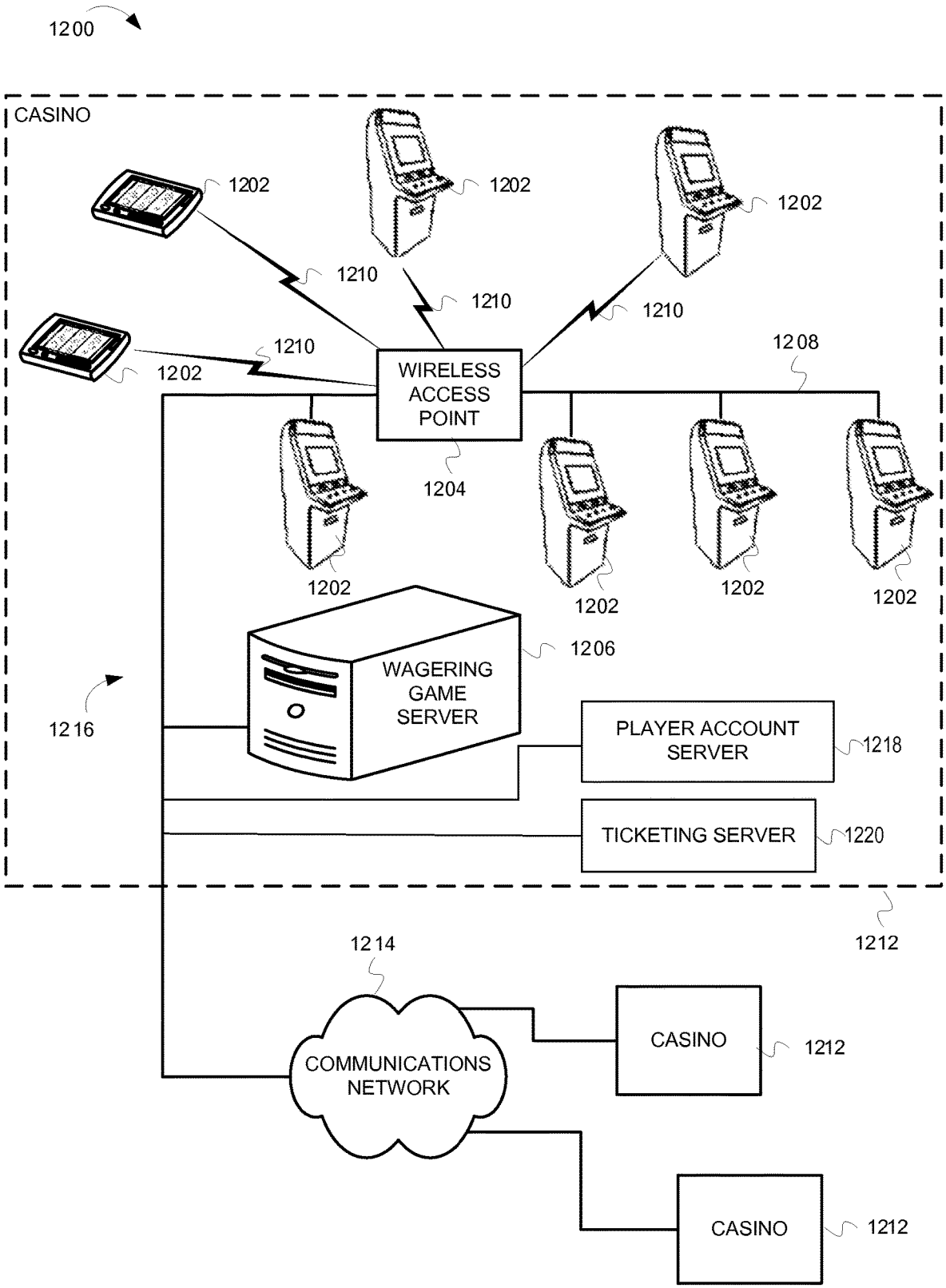
FIG. 12 is a block diagram illustrating a wagering game network 600, according, to example embodiments of the invention.

FIG. 12 is a block diagram illustrating a wagering game network 1200, according to example embodiments of the invention. As shown in FIG. 12, the wagering game network 1200 includes a plurality of casinos 1212 connected to a communications network 1214.

Each casino 1212 includes a local area network 1216, which includes an access point 1204, a wagering game server 1206, a player account server 1218, a ticketing server 1220, and wagering game machines 1202. The access point 1204 provides wireless communication links 1210 and wired communication links 1208. The wired and wireless communication links can employ any suitable connection technology, such as Bluetooth, 802.11, Ethernet, public switched telephone networks, SONET, etc. In some embodiments, the wagering game server 1206 can serve wagering games and distribute content to devices located in other casinos 1212 or at other locations on the communications network 1214.

The wagering game machines 1202 described herein can take any suitable form, such as floor standing models, handheld mobile units, bartop models, workstation-type console models, etc. Further, the wagering game machines 1202 can be primarily dedicated for use in conducting wagering games, or can include non-dedicated devices, such as mobile phones, personal digital assistants, personal computers, etc. In one embodiment, the wagering game network 1200 can include other network devices, such as accounting servers, wide area progressive servers, player tracking servers, and/or other devices suitable for use in connection with embodiments of the invention.

In some embodiments, wagering game machines 1202 and wagering game servers 1206 work together such that a wagering game machine 1202 can be operated as a thin, thick, or intermediate client. For example, one or more elements of game play may be controlled by the wagering game machine 1202 (client) or the wagering game server 1206 (server). Game play elements can include executable game code, lookup tables, configuration files, game outcome, audio or visual representations of the game, game assets or the like. In a thin-client example, the wagering game server 1206 can perform functions such as determining game outcome or managing assets, while the wagering game machine 1202 can present a graphical representation of such outcome or asset modification to the user (e.g., player). In a thick-client example, the wagering game machines 1202 can determine game outcomes and communicate the outcomes to the wagering game server 1206 for recording or managing a player's account.

In some embodiments, either the wagering game machines 1202 (client) or the wagering game server 1206 can provide functionality that is not directly related to game play. For example, account transactions and account rules may be managed centrally (e.g., by the wagering game server 1206) or locally (e.g., by the wagering game machine 1202). Other functionality not directly related to game play may include power management, presentation of advertising, software or firmware updates, system quality or security checks, etc. Additionally, in some embodiments, the player account server 1218 can store and provide access to player accounts. Additionally, the player account server 1218 can perform transactions relating to the player accounts. In some embodiments, the ticket server 1220 provides functionality relating to wagering game tickets, such as verifying wagering game tickets, producing wagering game tickets, determining monetary value associated with wagering game tickets, etc.

Any of the wagering game network components (e.g., the wagering game machines 1202) can include hardware and machine-readable media including instructions for performing the operations described herein.

Wagering Game Machine Architectures

Figure 13:
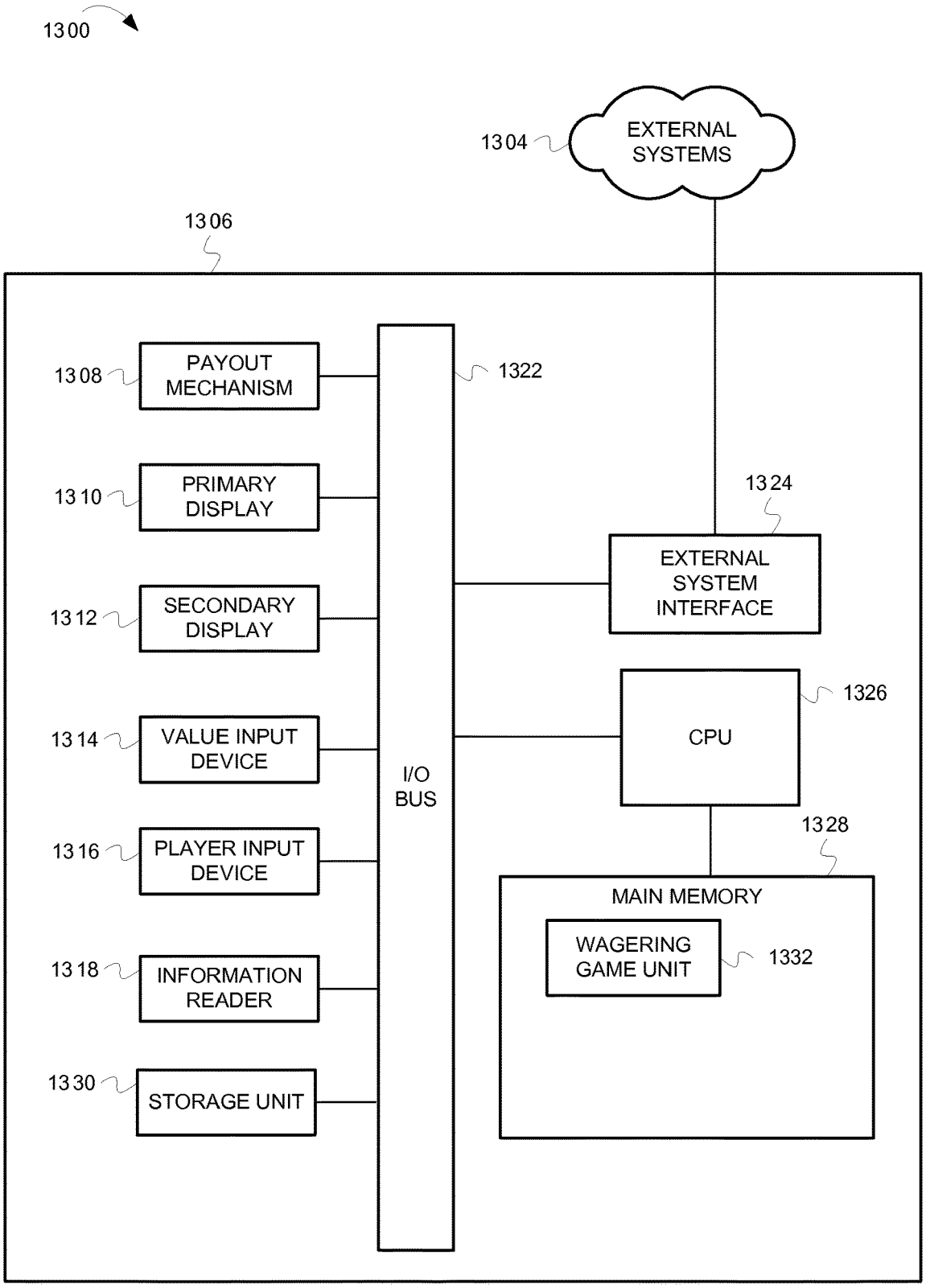
FIG. 13 is a block diagram illustrating a wagering game machine architecture, according to example embodiments of the invention.

FIG. 13 is a block diagram illustrating a wagering game machine architecture, according to example embodiments of the invention. As shown in FIG. 13, the wagering game machine architecture 1300 includes a wagering game machine 1306, which includes a central processing unit (CPU) 1326 connected to main memory 1328. The CPU 1326 can include any suitable processor, such as an Intel® Pentium processor, Intel® Core 2 Duo processor, AMD Opteron™ processor, or UltraSPARC processor. The main memory 1328 includes a wagering game unit 1332. In one embodiment, the wagering game unit 1332 can present wagering games, such as video poker, video blackjack, video slots, video lottery, etc., in whole or part.

The CPU 1326 is also connected to an input/output (I/O) bus 1322, which can include any suitable bus technologies, such as an AGTL+ frontside bus and a PCI backside bus. The I/O bus 1322 is connected to a payout mechanism 1308, primary display 1310, secondary display 1312, value input device 1314, player input device 1316, information reader 1318, and storage unit 1330. The player input device 1316 can include the value input device 1314 to the extent the player input device 1316 is used to place wagers. The I/O bus 1322 is also connected to an external system interface 1324, which is connected to external systems 1304 (e.g., wagering game networks). In some embodiments, the payout mechanism 1308 can include a ticket printer for printing wagering game tickets.

In one embodiment, the wagering game machine 1306 can include additional peripheral devices and/or more than one of each component shown in FIG. 13. For example, in one embodiment, the wagering game machine 1306 can include multiple external system interfaces 1324 and/or multiple CPUs 1326. In one embodiment, any of the components can be integrated or subdivided.

Any component of the architecture 1300 can include hardware, firmware, and/or machine-readable media including instructions for performing the operations described herein. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

While FIG. 13 describes an example wagering game machine architecture, this section continues with a discussion wagering game networks.

Example Wagering Game Machines

Figure 14:
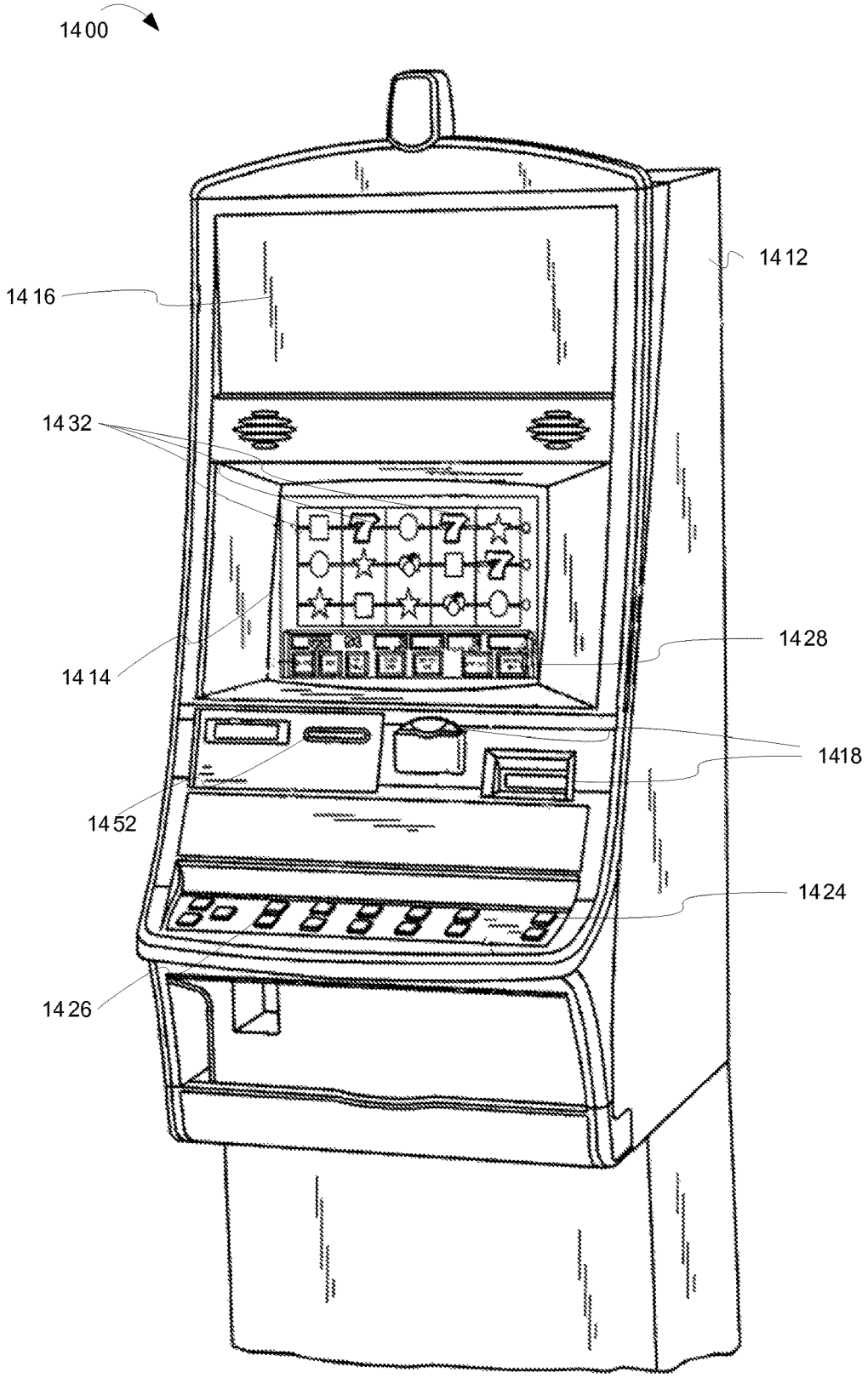
FIG. 14 is a perspective view of a wagering game machine, according to example embodiments of the invention.

FIG. 14 is a perspective view of a wagering game machine, according to example embodiments of the invention. Referring to FIG. 14, a wagering game machine 1400 is used in gaming establishments, such as casinos. According to embodiments, the wagering game machine 1400 can be any type of wagering game machine and can have varying structures and methods of operation. For example, the wagering game machine 1400 can be an electromechanical wagering game machine configured to play mechanical slots, or it can be an electronic wagering game machine configured to play video casino games, such as blackjack, slots, keno, poker, blackjack, roulette, etc.

The wagering game machine 1400 comprises a housing 1412 and includes input devices, including value input devices 1418 and a player input device 1424. For output, the wagering game machine 1400 includes a primary display 1414 for displaying information about a basic wagering game. The primary display 1414 can also display information about a bonus wagering game and a progressive wagering game. The wagering game machine 1400 also includes a secondary display 1416 for displaying wagering game events, wagering game outcomes, and/or signage information. While some components of the wagering game machine 1400 are described herein, numerous other elements can exist and can be used in any number or combination to create varying forms of the wagering game machine 1400.

The value input devices 1418 can take any suitable form and can be located on the front of the housing 1412. The value input devices 1418 can receive currency and/or credits inserted by a player. The value input devices 1418 can include coin acceptors for receiving coin currency and bill acceptors for receiving paper currency. Furthermore, the value input devices 1418 can include ticket readers or barcode scanners for reading information stored on vouchers, cards, or other tangible portable storage devices. The vouchers or cards can authorize access to central accounts, which can transfer money to the wagering game machine 1400.

The player input device 1424 comprises a plurality of push buttons on a button panel 1426 for operating the wagering game machine 1400. In addition, or alternatively, the player input device 1424 can comprise a touch screen 1428 mounted over the primary display 1414 and/or secondary display 1416.

The various components of the wagering game machine 1400 can be connected directly to, or contained within, the housing 1412. Alternatively, some of the wagering game machine's components can be located outside of the housing 1412, while being communicatively coupled with the wagering game machine 1400 using any suitable wired or wireless communication technology.

The operation of the basic wagering game can be displayed to the player on the primary display 1414. The primary display 1414 can also display a bonus game associated with the basic wagering game. The primary display 1414 can include a cathode ray tube (CRT), a high resolution liquid crystal display (LCD), a plasma display, light emitting diodes (LEDs), or any other type of display suitable for use in the wagering game machine 1400. Alternatively, the primary display 1414 can include a number of mechanical reels to display the outcome. In FIG. 14, the wagering game machine 1400 is an "upright" version in which the primary display 1414 is oriented vertically relative to the player. Alternatively, the wagering game machine can be a "slant-top" version in which the primary display 1414 is slanted at about a thirty-degree angle toward the player of the wagering game machine 1400. In yet another embodiment, the wagering game machine 1400 can exhibit any suitable form factor, such as a free standing model, bartop model, mobile handheld model, or workstation console model.

A player begins playing a basic wagering game by making a wager via the value input device 1418. The player can initiate play by using the player input device's buttons or touch screen 1428. The basic game can include arranging a plurality of symbols along a payline 1432, which indicates one or more outcomes of the basic game. Such outcomes can be randomly selected in response to player input. At least one of the outcomes, which can include any variation or combination of symbols, can trigger a bonus game.

In some embodiments, the wagering game machine 1400 can also include an information reader 1452, which can include a card reader, ticket reader, bar code scanner, RFID transceiver, or computer readable storage medium interface. In some embodiments, the information reader 1452 can be used to award complimentary services, restore game assets, track player habits, etc.

Processing E-Tickets

Typically, when a player wishes to cash out (i.e., remove any value remaining on a wagering game machine from the wagering game machine), the wagering game machine creates a physical ticket (e.g., prints a paper ticket) representing the value remaining on the wagering game machine. The player then takes the physical ticket to a cashier or kiosk to redeem the physical ticket for cash. Embodiments of the inventive subject matter create e-tickets that can be stored on a mobile device in addition to, or in lieu of, physical tickets. An e-ticket is a wagering game ticket that is stored electronically. E-tickets can include all information that a wagering game ticket includes (e.g., a unique identifier, a monetary value, a player account number, etc.). E-tickets can be redeemed using scanning systems. Scanning systems can be located, for example, at a cage or cashier station in a casino or at a kiosk. When a player wishes to cash out after playing wagering games on a mobile device, an e-ticket is created and stored on the player's mobile device. The player can redeem the e-ticket for cash by scanning the e-ticket using the scanning system. The scanning system can process a virtual image of an e-ticket (e.g., a graphical image), or can transmit the virtual image of the e-ticket for processing by other components. This discussion will continue with a description of embodiments that inter alia create, scan, and redeem e-tickets.

Figure 15A:
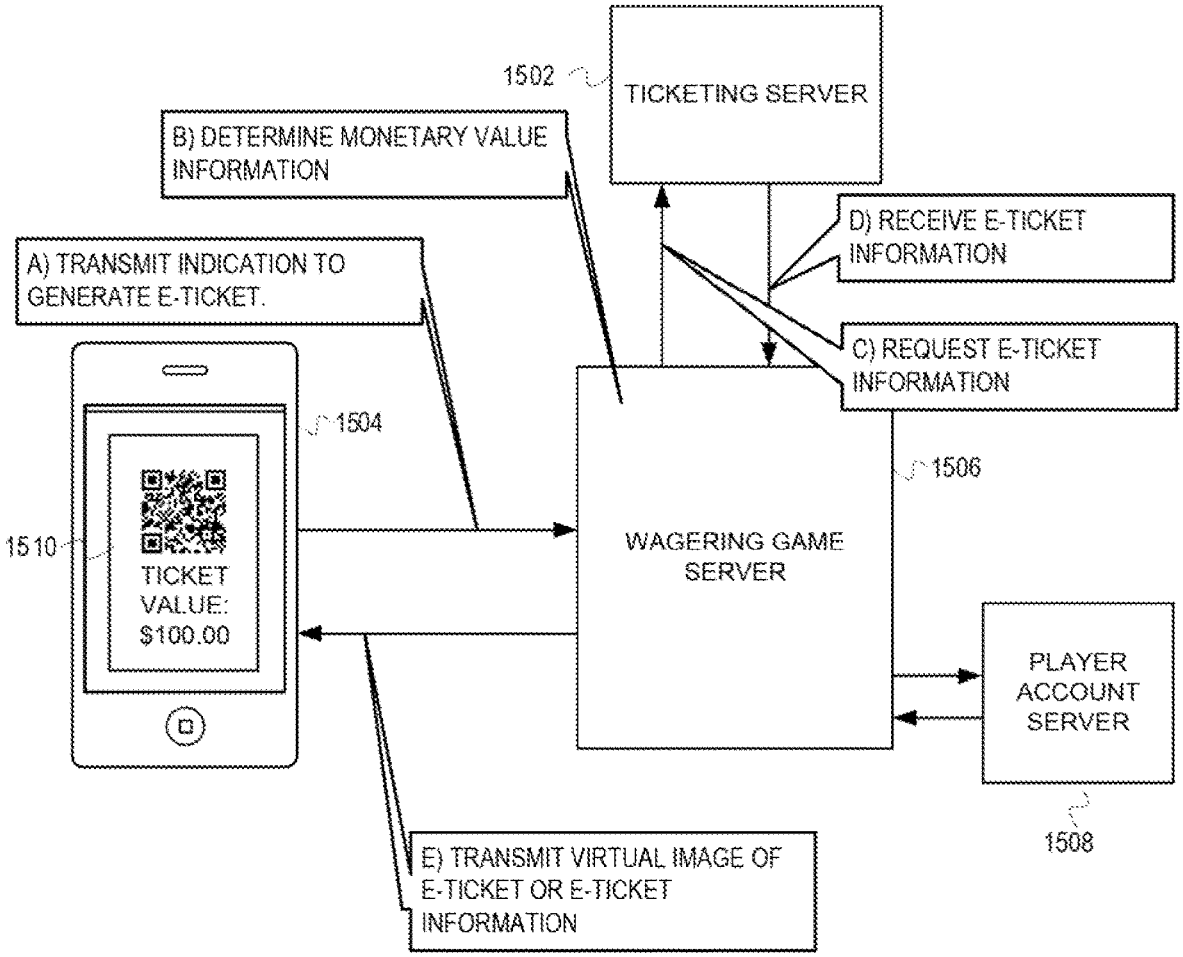
FIG. 15A depicts a system for creating an e-ticket for storage on a mobile device 1504.

FIG. 15A depicts a system for creating an e-ticket for storage on a mobile device 1504. The system includes a mobile device 1504, a wagering game server 1506, a player account server 1508, and a ticketing server 1502. FIG. 15A depicts operations at stages A-E. The stages are examples and are not necessarily discrete occurrences over time (e.g., operations of different stages may overlap). Additionally, some embodiments of the inventive subject matter may include different stages than those depicted in FIG. 15A (e.g., additional stages, fewer stages, etc.).

At stage A, the mobile device 1504 transmits an indication to generate an e-ticket to the wagering game server 1506. For example, when a player requests to cash out on the mobile device 1504, the mobile device 1504 transmits an indication to generate an e-ticket to the wagering game server 1506.

At stage B, the wagering game server 1506 determines monetary value information for the e-ticket. For example, the monetary value information can include the player's balance at the time the player wishes to cash out. Embodiments of the system can store account balances in different ways. For example, some embodiments create game session accounts for tracking session balances. In such embodiments, the monetary value information is stored on the wagering game server 1506. For example, when the player deposits monetary value to initiate a wagering game session on the mobile device 1504, an account (e.g., a game session account) is created for the wagering game session, where the account exists for the duration of the wagering game session. In some embodiments, the account is not associated with a specific player. Rather, the account may be linked to the mobile device 1504 based on a unique identifier for the mobile device 1504 (e.g., the mobile device's 1504 MAC address). Alternatively, the account may be linked to a session identifier known by the mobile device 1504 and the wagering game server 1506. As the player plays wagering games during the wagering game session, an account balance for the account is updated on the wagering game server, based on results of the wagering games.

In other embodiments, the monetary value information is stored on the player account server 1508. For example, during an account-based wagering game session, when the player deposits money to initiate a wagering game session on the mobile device 1504, the player account server 1508 updates a persistent player account associated with the player to reflect the deposit. The player account server 1508 updates a balance of the player account as the player plays wagering games during the wagering game session. In such embodiments, the wagering game server determines the monetary value information by requesting the balance of the player account from the player account server 1508. In response, the player account server 1508 transmits the monetary value information (i.e., the balance of the player account) to the wagering game server 1506.

At stage C, the wagering game server 1506 requests e-ticket information from the ticketing server 1502. For example, the wagering game server 1506 transmits the monetary value information to the ticketing server 1502 and requests e-ticket information based on the monetary value information from the ticketing server 1502. In response to the request for e-ticket information, the ticketing server 1502 creates the e-ticket information. The e-ticket information associates the e-ticket with an indication of the monetary value information stored on the ticketing server 1502. For example, the ticketing server 1502 can maintain a database of voucher numbers (or other suitable unique identifiers) and the monetary value associated with each voucher number. In this example, the e-ticket information would include the voucher number that is associated with the monetary value for the e-ticket. After creating the e-ticket information, the ticketing server 1502 transmits the e-ticket information to the wagering game server 1506.

At stage D, the wagering game server 1506 receives the e-ticket information from the ticketing server 1502. In some embodiments, after receiving the e-ticket information, the wagering game server 1506 creates a virtual image of the e-ticket 1510. In such embodiments, at stage E, the wagering game server 1506 transmits the virtual image of the e-ticket 1510 to the mobile device 1504. In other embodiments, at stage E, the wagering game server 1506 transmits the e-ticket information to the mobile device 1504. In such embodiments, the mobile device 1504 creates a virtual image of the e-ticket 1510 based on the e-ticket information.

Figure 15B:
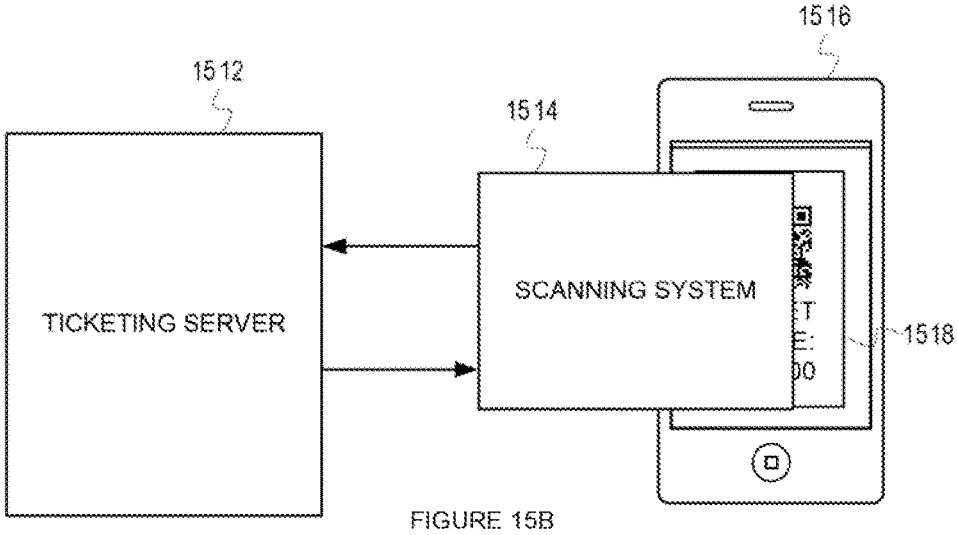
FIG. 15B depicts a system for redeeming an e-ticket stored on a mobile device 1514 using a scanning system 1512.

FIG. 15B depicts redeeming an e-ticket stored on a mobile device 1514 using a scanning system 1512. As previously discussed, when a player cashes out, typical wagering game systems create a physical ticket representing monetary value remaining on a wagering game machine. The player takes the physical ticket to a cashier and redeems the physical ticket for cash. According to some embodiments of the inventive subject matter, the player can present a virtual image of an e-ticket 1518 to a scanning system 1514 to redeem the e-ticket for cash.

The scanning system 1514 can include a scanner or any other mechanism for capturing information presented on the mobile device 1516 or receiving information transmitted by the mobile device 1516. Scanning systems can be used by casino personal, for example, at a cashier or cage in a casino. Additionally, kiosks can be equipped with scanning systems to provide automated redemption of e-tickets. The player (or a cashier) places the mobile device 1516 in view of a scanner of the scanning system 1514. The scanner of the scanning system 1514 scans the virtual image of the e-ticket 1518 to acquire the e-ticket information contained in the virtual image of the e-ticket 1518. In some embodiments, the scanning system 1514 captures an image of the virtual image of the e-ticket 1518. In other embodiments, the scanning system 1514 reads the e-ticket information off of the virtual image of the e-ticket 1518 (e.g., using character recognition technology). The e-ticket information contained in the virtual image of the e-ticket 1518 can take any suitable form. For example, the information can be a one-dimensional barcode, a two-dimensional barcode, an alphanumeric code, etc. Furthermore, the e-ticket information can be the voucher number assigned to the e-ticket, or can be a different unique identifier. For example, when the player begins a wagering game session by depositing money, the deposit can be assigned a unique six digit number. When an e-ticket is created (e.g., when the player deposits additional money, cashes out, etc.), the voucher number associated with the e-ticket can be linked to the six digit number. In such embodiments, although a new e-ticket is created for each transaction, the original six digit number associated with the deposit persists.

In some embodiments, the scanning system 1514 must decode the virtual image of the e-ticket 1518 to obtain the e-ticket information. For example, if the e-ticket information is contained in a barcode, the scanning system 1514 decodes the barcode to obtain the e-ticket information. The scanning system 1514 then transmits the e-ticket information to the ticketing server 1512. The ticketing server 1512 verifies the e-ticket information and transmits a verification message back to the scanning system 1514. For example, the ticketing server 1512 can access a database containing voucher numbers to verify that the e-ticket is not fraudulent and that the e-ticket has not previously been redeemed. After receiving the verification message from the ticketing server 1512, the scanning system 1514 can redeem the e-ticket. For example, if the scanning system 1514 is part of a kiosk, the scanning system 1514 can instruct the kiosk to dispense cash to the player. If the scanning system 1514 is used by a cashier in a casino, the scanning system 1514 can instruct the cashier to distribute cash to the player.

Although the discussion of FIG. 15B refers to the scanning system 1514 optically obtaining the e-ticket information, embodiments are not so limited. For example, the mobile device 1516 can communicate the e-ticket information to the scanning system 1514 via a wireless transmission (e.g., Bluetooth, NFC, WiFi, etc.) or audibly. In such embodiments, the scanning system 1514 decodes the transmission and transmits the e-ticket information to the ticketing server 1512.

Figure 16:
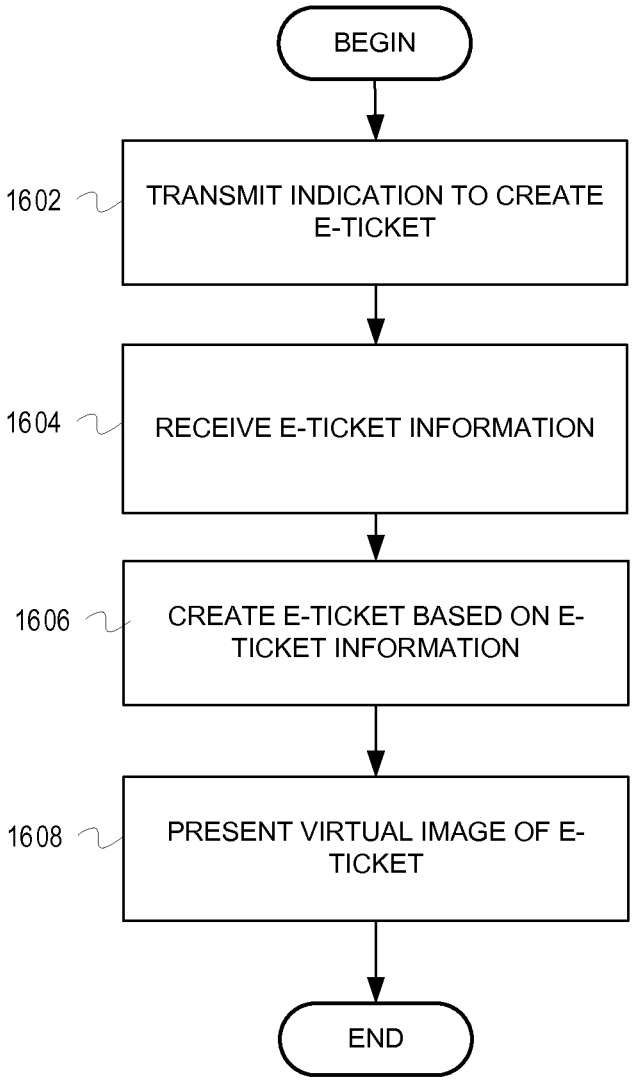
FIG. 16 is a flow diagram depicting example operations for creating an e-ticket for storage on a mobile device and redeeming the e-ticket, according to example embodiments of the invention.

FIG. 16 is a flow diagram depicting example operations for creating an e-ticket for storage on a mobile device and redeeming the e-ticket, according to example embodiments of the invention. The flow begins at block 1602.

At block 1602, a mobile device transmits an indication to create an e-ticket to a wagering game server. For example, when a player presses a "cash out" button on the mobile device, the mobile device can transmit an indication to create an e-ticket to the wagering game server. The player can redeem the e-ticket using a scanning system. The e-ticket is similar to a conventional physical wagering game ticket. However, a mobile device stores the e-ticket so that the player does not have to keep track of a physical ticket. The flow continues at block 1604.

At block 1604, the mobile device receives e-ticket information from the wagering game server. In some embodiments, the e-ticket information is a voucher number that has been assigned to the e-ticket. Additionally, the e-ticket information can include monetary value information (i.e., the value of the e-ticket), player account information, a player identifier, etc. The flow continues at block 1606.

At block 1606, the mobile device creates an e-ticket based on the e-ticket information. For example, the mobile device generates a unique identifier (e.g., a barcode) based on the e-ticket information. Like a conventional physical wagering game ticket, the e-ticket can include the unique identifier, an indication of the e-ticket value, the name of the player associated with the e-ticket, and the player's player account number. It is not necessary however that the e-ticket include all of this information. For example, in embodiments in which a game session account is linked to a mobile device (as opposed to a specific player), the e-ticket may not be linked to a specific player. In such embodiments, the e-ticket may only include the unique identifier. Additionally, in some embodiments, the e-ticket can include more information than is listed above (e.g., a timestamp, a casino name, etc.). The mobile device compiles all of the information to be included in the e-ticket and creates the e-ticket based on the information. The flow continues at block 1608.

At block 1608, the mobile device presents a virtual image of the e-ticket. The mobile device can present the virtual image of the e-ticket to the player, or the mobile device can present the virtual image of the e-ticket to a scanning system to redeem the e-ticket. As previously discussed, in some embodiments, the mobile device does not visually present the virtual image of the e-ticket to a scanning system. For example, the mobile device can transmit the e-ticket information to the scanning system using any suitable means (e.g., Bluetooth, NFC, WiFi, etc.).

Figure 17:
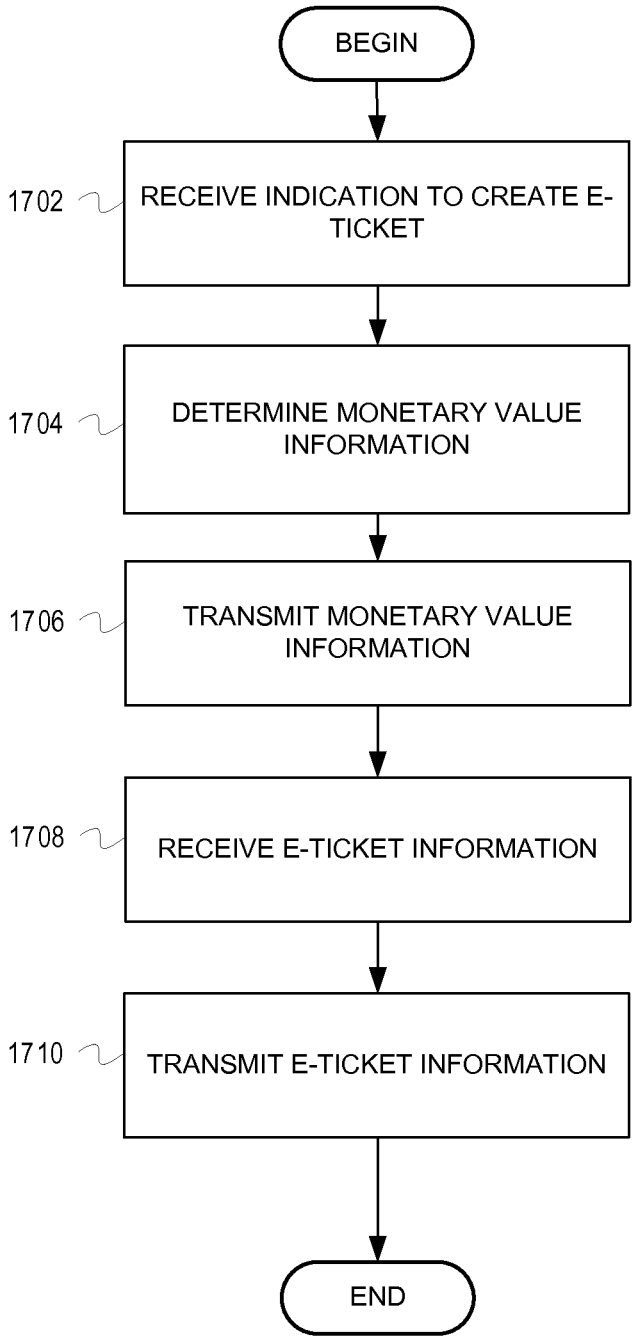
FIG. 17 is a flow diagram depicting example operations for creating an e-ticket for storage on a mobile device, according to example embodiments of the invention.

FIG. 17 is a flow diagram depicting example operations for creating an e-ticket for storage on a mobile device, according to example embodiments of the invention. The flow begins at block 1702.

At block 1702, a wagering game server receives an indication to create an e-ticket from a mobile device. The flow continues at block 1704.

At block 1704, the wagering game server determines monetary value information for the e-ticket. In some embodiments, the wagering game server stores a balance for a player. For example, some embodiments can create game session accounts for tracking session balances. In such embodiments, the monetary balance information may be stored on the wagering game server. For example, when the player deposits money to initiate a wagering game session, the wagering game server creates an account that is associated with the mobile device. The account can be associated with the mobile device based on a unique identifier for the mobile device (e.g., the mobile device's MAC address). In such embodiments, the wagering game server determines the monetary value information by accessing a database (or other data structure) to determine the balance for the account. In other embodiments, accounts are associated with players. In such embodiments, a player account server stores persistent account balances for a persistent player account. When a player deposits money to initiate a wagering game session, the player account server updates a balance of the player account to reflect the deposit. The wagering game server determines the monetary value information by querying the player account server. The wagering game server receives the monetary value information from the player account server. In some embodiments, in addition to determining the monetary value information, the wagering game server determines player account information. For example, the wagering game server can request a player identifier, a player name, etc. from the player account server. The flow continues at block 1706.

At block 1706, the wagering game server transmits the monetary value information to a ticketing server. The ticketing server generates e-ticket information based on the monetary value information. The e-ticket information associates the e-ticket with the monetary value information stored on the ticketing server for the e-ticket. For example, the e-ticket information can include a voucher number that is assigned to the e-ticket. The flow continues at block 1708.

At block 1708, the wagering game server receives the e-ticket information from the ticketing server. The flow continues at block 1710.

At block 1710, the wagering game server transmits the e-ticket information to the mobile device. In some embodiments, the wagering game server also transmits the player account information to the mobile device. Although the discussion of FIG. 16 describes creation of an e-ticket by a mobile device, in some embodiments, the wagering game server creates the e-ticket. In such embodiments, the wagering game server creates the e-ticket and transmits the e-ticket, or a virtual image of the e-ticket, to the mobile device.

Figure 18:
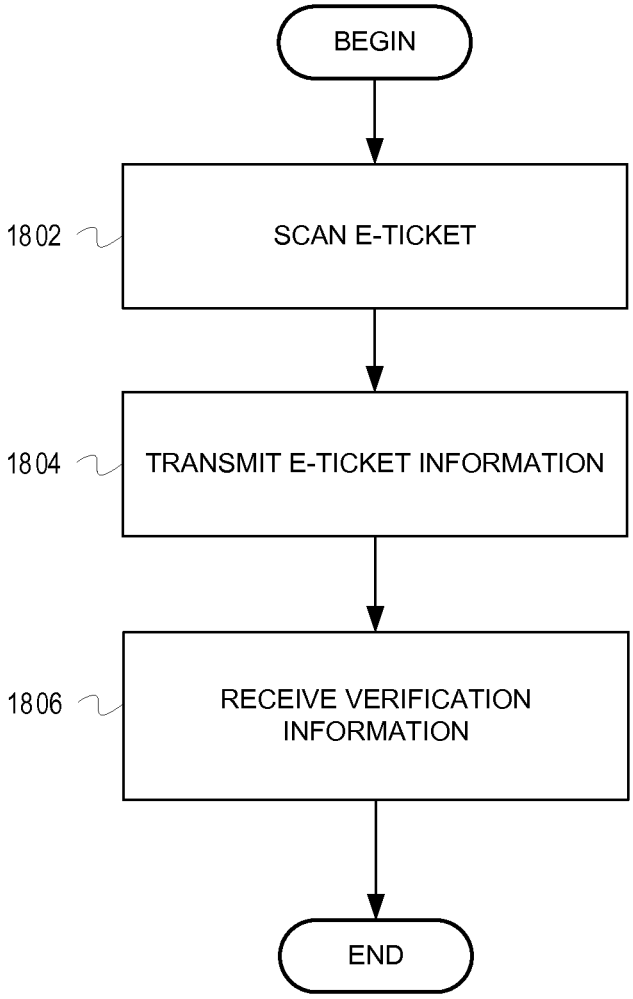
FIG. 18 is a flow diagram depicting example operations for redeeming an e-ticket stored on a mobile device using a scanning system, according to example embodiments of the invention.

FIG. 18 is a flow diagram depicting example operations for redeeming an e-ticket stored on a mobile device using a scanning system, according to example embodiments of the invention. The flow begins at block 1802.

At block 1802, the scanning system scans the e-ticket. In some embodiments, the scanning system includes a visual scanner (e.g., an optical laser scanner) and the visual scanner scans the virtual image of the e-ticket from the mobile device. In other embodiments, the scanning system receives e-ticket information associated with the e-ticket by non-visual means. For example, the scanning system can include a microphone and the mobile device audibly transmits the e-ticket information to the mobile device. As another example, the scanning system can receive the e-ticket information from the mobile device via a wireless transmission (e.g., Bluetooth, NFC, WiFi, etc.). As another example, the scanning system can receive the e-ticket information via user input. In such embodiments, the player or a casino employee can manually enter the e-ticket information at the scanning system. Additionally, in some embodiments, after scanning the virtual image of the e-ticket (or otherwise receiving the e-ticket information), the scanning system decodes the virtual image of the e-ticket to determine the e-ticket information. For example, if the e-ticket information is contained in a barcode, the scanning system decodes the barcode to obtain the e-ticket information. The flow continues at block 1804.

At block 1804, the scanning system transmits the e-ticket information to a ticketing server. The ticketing server can verify the authenticity of the e-ticket by referencing the e-ticket information against a list of voucher numbers. The ticketing server can also verify that the e-ticket has not previously been redeemed, has not expired, etc. In some embodiments, the scanning system transmits the virtual image of the e-ticket to the ticketing server. In such embodiments, the ticketing server processes (e.g., decodes) the virtual image of the e-ticket to determine the e-ticket information. The flow continues at block 1806.

At block 1806, the scanning system receives verification information from the ticketing server. If the ticketing server determines that the e-ticket is valid and has not previously been redeemed, the ticketing server can transmit a verification message to the scanning system indicating that the e-ticket is valid and has not previously been redeemed. After the scanning system receives the verification information from the ticketing server, the scanning system can distribute money to the player, or instruct a casino employee to distribute money to the player.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for operating a wagering game system in an electronic wagering game network, the method comprising:

determining, by a wagering game server, wagering game results during a wagering game session occurring on a mobile device;

transmitting, by the wagering game server over a network to the mobile device, the game results for presentation on a display device of the mobile device;

presenting, by the mobile device, the game results on the display device;

receiving, by the wagering game server from the mobile device over the network, an indication to create an e-ticket;

determining, by the wagering game server, monetary value information for the e-ticket;

transmitting, by the wagering game server to a ticketing server, the monetary value information;

receiving, by the wagering game server from the ticketing server, e-ticket information associated with the e-ticket;

transmitting, by the wagering game server over the network, the e-ticket information to the mobile device;

receiving, by the mobile device, the e-ticket information;

presenting, by the mobile device, a graphical representation of the e-ticket to a scanning system to redeem the e-ticket;

authenticating the e-ticket via the ticketing server;

receiving, from the ticketing server, authorization to pay the monetary value of the e-ticket; and providing the monetary value of the e-ticket in response to the authorization.

2. The method of claim 1 further including:

generating, by the wagering game server, the graphical image including the monetary value information; and including, by the wagering game server, the graphical image as part of the e-ticket information.

3. The method of claim 1, further comprising:

determining information associated with a monetary player account including a monetary balance for the monetary player account; and transmitting the information associated with the monetary player account to the mobile device.

4. The method of claim 3, wherein the monetary player account is associated with a player.

5. The method of claim 3, wherein the information associated with the monetary player account includes an identifier uniquely identifying the monetary player account.

6. The method of claim 1, wherein the determining the monetary value information comprises:

requesting, by the wagering game server from a player account server, the monetary value information; and receiving, by the wagering game server from the player account server, the monetary value information.

7. The method of claim 1, wherein the e-ticket includes indicia indicating the e-ticket information.

8. The method of claim 1, wherein the e-ticket information includes a unique identifier uniquely identifying the e-ticket.

9. The method of claim 1, wherein the redeeming further includes:

visually scanning, via visual scanner of the scanning system, the graphical representation of the e-ticket that was presented by the mobile device to determine a unique ticket identifier and the monetary value of the e-ticket.

10. One or more non-transitory machine-readable storage media having instructions stored therein, which when executed by one or more processors, cause the one or more processors to perform operations for processing an e-ticket based on a wagering game on a mobile device, the instructions comprising:

instructions to receive, via an input device of the mobile device, input associated with the wagering game;

instructions to determine, by a wagering game server, a result for the wagering game;

instructions to present, on a display device of the mobile device, the result for the wagering game;

instructions to detect, by the mobile device, a cash-out request;

instructions to transmit, to the wagering game server, a request for the e-ticket over a network in response to the cash-out request;

instructions to determine, by the wagering game server, monetary value information for the e-ticket;

instructions to transmit, by the wagering game server to a ticketing server, the monetary value information;

instructions to receive, by the wagering game server from the ticketing server, e-ticket information associated with the e-ticket;

instructions to transmit, by the wagering game server over the network, the e-ticket information to the mobile device;

instructions to receive, by the mobile device over the network, the e-ticket information including a unique e-ticket identifier and the monetary value information; and instructions to present, on the display device of the mobile device, a graphical representation of the e-ticket for redemption via a scanning system;

instructions to authenticate the e-ticket via the ticketing server;

instructions to receive, from the ticketing server, authorization to pay the monetary value of the e-ticket; and instructions to provide the monetary value based in response to the authorization.

11. The one or more non-transitory machine-readable storage media of claim 10, wherein the e-ticket information includes the graphical representation of the e-ticket.

12. The one or more non-transitory machine-readable storage media of claim 10, wherein the instructions further comprise:

instructions to present audio content to a ticket scanning system, wherein the audio content indicates the unique identifier and the monetary value.

13. The one or more non-transitory machine-readable storage media of claim 10, wherein the instructions further comprise:

instructions to authenticate, by a ticketing server, the e-ticket;

instructions to transmit, by the ticketing server, authorization to pay the monetary value.

14. The one or more non-transitory machine-readable storage media of claim 10, wherein the instructions to authenticate include:

instructions to transmit the unique identifier over the network to a ticketing server;

instructions to receive authorization to pay the monetary value.

15. A system comprising:

a wagering game server including one or more machine-readable media including instructions that, when executed by one or more processors, cause the one or more processors to perform operations for controlling the wagering game server, the instructions including instructions to determine results for wagering games for presentation on a mobile device;

instructions to detect a request for an e-ticket by the mobile device;

instructions to determine a monetary value for the e-ticket information;

instructions to transmit the monetary value to a ticking server;

instructions to receive e-ticket information associated with the e-ticket from the ticketing server;

instructions to transmit e-ticket information to the mobile device;

the mobile device including one or more machine-readable media including instructions that, when executed by one or more processors, cause the one or more processors to perform operations for controlling the mobile device, the instructions including instructions to present the results for the wagering games during a wagering game session;

instructions to detect a cash out request during the wagering game session;

instructions to transmit the request for the e-ticket information to the wagering game server over a network;

instructions to receive the e-ticket information; and instructions to present a graphical representation of the e-ticket, based on the e-ticket information, on a display device to a scanning system to redeem the e-ticket for monetary value;

the scanning system including one or more machine-readable media including instructions that, when executed by one or more processors, cause the one or more processors to perform operations for controlling the mobile device, the instructions including instructions to authenticate the e-ticket via the ticketing server; and instructions to receive, from the ticketing server, authorization to pay the monetary value of the e-ticket.

16. The system of claim 15 further comprising:

a ticketing server including one or more machine-readable media including instructions that, when executed by one or more processors, cause the one or more processors to perform operations for controlling the ticketing server, the instructions including instructions to receive a request for a unique identifier from the wagering game server;

instructions to determine the unique identifier; and instructions to transmit the unique identifier to the wagering game server.

17. The system of claim 15, wherein the scanning system further includes:

instructions to visually scan the graphical representation of the e-ticket;

instructions to determine the unique identifier and monetary value; and instructions to transmit the unique identifier and monetary value for authentication by the ticketing server.

18. The system of claim 15, wherein the wagering game server stores the monetary value in a game session account.

19. The system of claim 15, wherein the monetary value is stored in a player account server, and wherein the wagering game server further includes instructions to request and receive the monetary value from the player account server.

20. The system of claim 15, wherein the mobile device further includes instructions to transmit the e-ticket information via audible signals.

21. The system of claim 15, wherein the e-ticket information includes the graphical representation of the e-ticket.

22. The method of claim 1, wherein providing the monetary value further includes:

causing a kiosk to dispense money value associated with the e-ticket.

* * * * *